US008438757B2

(12) United States Patent
Roser

(10) Patent No.: US 8,438,757 B2
(45) Date of Patent: May 14, 2013

(54) HUMAN LOCOMOTION ASSISTING SHOE

(76) Inventor: Mark Costin Roser, Hebron, CT (US)

( * ) Notice: Subject to any disclaimer, the term of this patent is extended or adjusted under 35 U.S.C. 154(b) by 448 days.

(21) Appl. No.: 12/720,408

(22) Filed: Mar. 9, 2010

(65) Prior Publication Data

US 2010/0319215 A1 Dec. 23, 2010

Related U.S. Application Data

(60) Provisional application No. 61/219,763, filed on Jun. 23, 2009, provisional application No. 61/293,621, filed on Jan. 9, 2010.

(51) Int. Cl.
*A43B 23/00* (2006.01)
*A43B 7/20* (2006.01)

(52) U.S. Cl.
USPC ..... 36/89; 36/45; 36/88

(58) Field of Classification Search ..... 36/27, 45, 36/88, 89, 102, 109
See application file for complete search history.

(56) References Cited

U.S. PATENT DOCUMENTS

| | | | | | |
|---|---|---|---|---|---|
| 3,535,800 | A * | 10/1970 | Stohr | 36/118.2 |
| 4,461,288 | A | 7/1984 | Curtis | |
| 5,090,138 | A | 2/1992 | Borden | |
| 5,125,171 | A * | 6/1992 | Stewart | 36/89 |
| 5,175,947 | A | 1/1993 | Parracho | |
| 5,621,985 | A | 4/1997 | Frost | |
| 5,647,150 | A * | 7/1997 | Romanato et al. | 36/117.1 |
| 5,678,330 | A * | 10/1997 | Van Dyke et al. | 36/89 |
| 5,924,706 | A * | 7/1999 | Seltzer et al. | 280/11.31 |
| 6,035,558 | A * | 3/2000 | Okajima | 36/117.1 |
| 6,397,496 | B1 | 6/2002 | Seymour | |
| 7,293,372 | B2 * | 11/2007 | Nakano | 36/45 |
| 7,509,756 | B2 * | 3/2009 | Lebo | 36/89 |
| 7,513,068 | B2 * | 4/2009 | Fauver | 36/118.4 |
| 7,913,426 | B2 * | 3/2011 | Valat et al. | 36/131 |
| 2003/0204971 | A1 * | 11/2003 | Fauver | 36/89 |
| 2006/0075663 | A1 * | 4/2006 | Nakano | 36/109 |
| 2006/0283048 | A1 * | 12/2006 | Lebo | 36/89 |
| 2007/0056189 | A1 * | 3/2007 | Schafer Mathison | 36/89 |
| 2009/0216167 | A1 * | 8/2009 | Harris | 602/27 |
| 2010/0192412 | A1 * | 8/2010 | Stewart | 36/89 |

FOREIGN PATENT DOCUMENTS

| | | |
|---|---|---|
| JP | 2009299104 | 11/1997 |
| JP | 2006197977 | 8/2006 |

* cited by examiner

*Primary Examiner* — Marie Patterson
(74) *Attorney, Agent, or Firm* — PCT Law Group, PLLC

(57) ABSTRACT

Embodiments of footwear, in particular, a shoe, sandal or boot, may reduce the effort and improve the performance of walking, running, hiking, marching, and various other gaits as well as jumping, hopping, and other motion involving the ankle and lower leg and Achilles tendon, through integration of force-carrying mechanisms within footwear that manage the forces and energy associated with such motion by productively harvesting and storing energy during dorsiflexion motion and releasing and returning energy during plantar flexion. One structural element of such footwear may comprise a top collar yoke having anterior and posterior gussets forming a channel and a shoe comprising a rotation zone supporting the channel and an elastomeric zone forming a tension spring via an elastomeric overlay or otherwise providing a spring-like member approximately parallel to and to assist the Achilles tendon during locomotion.

5 Claims, 12 Drawing Sheets

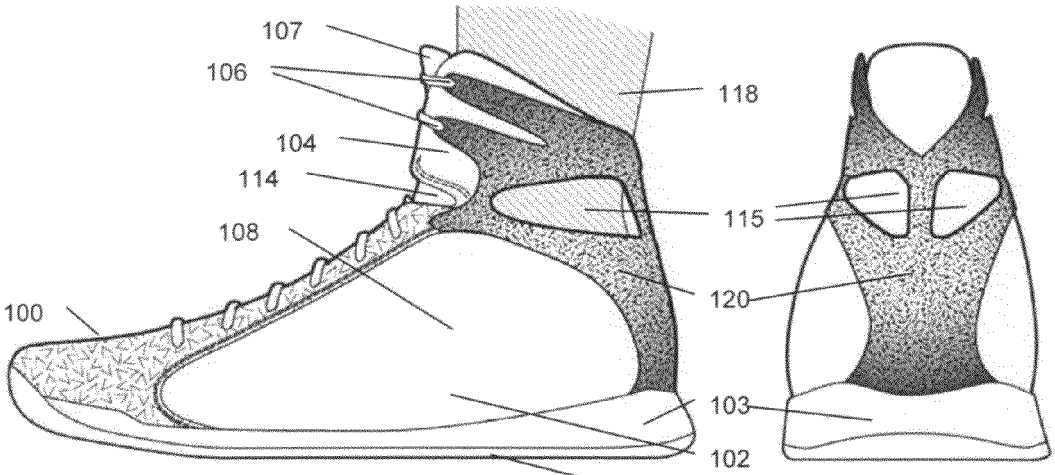
Fig. 1A
Fig. 1B
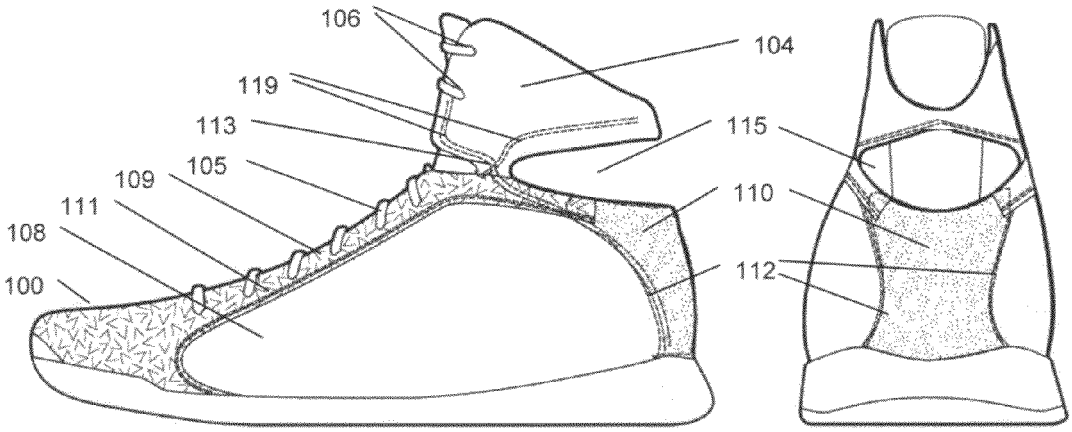
Fig. 2A
Fig. 2B
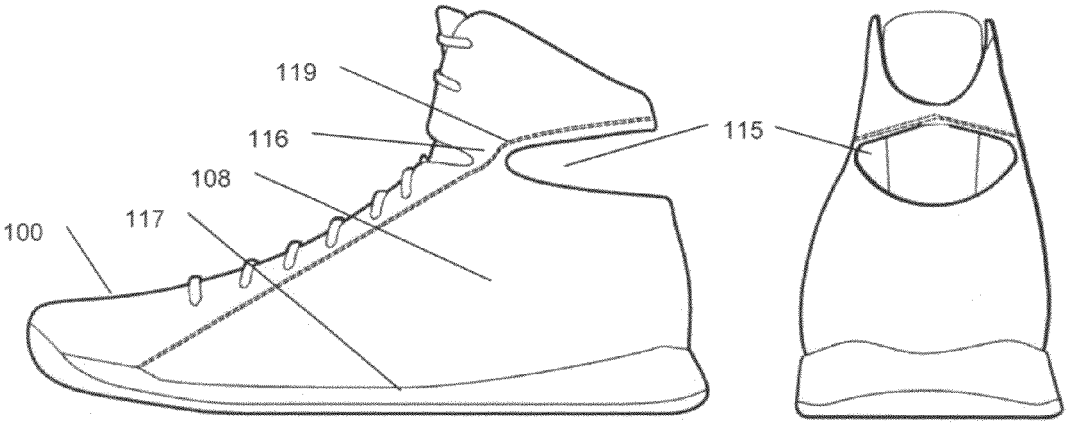
Fig. 3A
Fig. 3B

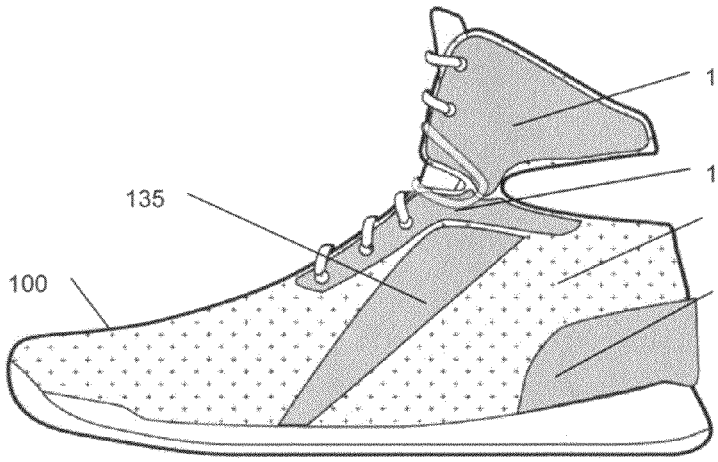
Fig. 6A
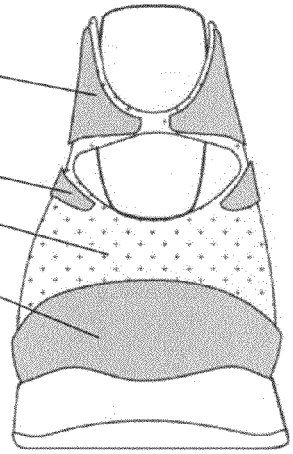
Fig. 6B
Fig. 6C
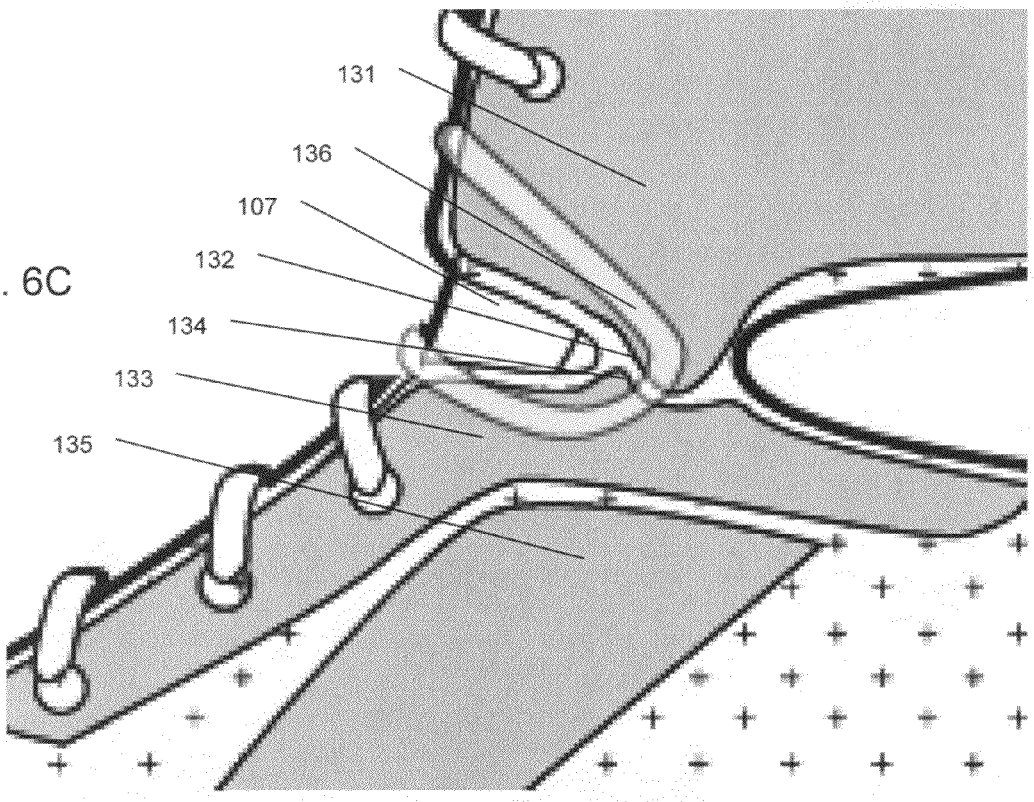

HUMAN LOCOMOTION ASSISTING SHOE

This application claims the benefit of U.S. Provisional Application Ser. No. 61/219,763 filed Jun. 23, 2009, entitled "Human Locomotion Assisting Shoe" and of U.S. Provisional Application Ser. No. 61/293,621, filed Jan. 9, 2010, entitled "Locomotion Assisting Shoe" of the same inventor, both of which applications are incorporated herein by reference as to their entire contents.

TECHNICAL FIELD

The technical field relates to the structural elements of several embodiments of footwear, for example, a shoe, a sandal or a boot and, in particular, to structural elements which may capture potential energy as an individual wearing the shoe moves and may release the energy such that the individual requires less energy to move than would be required when the structural elements of the several embodiments of the shoe are missing from their footwear.

BACKGROUND

Human motion requires exertion of energy. Peoples' ability to conduct their activities can be limited by their available energy. For example, hikers have a limit to the distance they can hike based upon their physiological constitution and condition. Runners have a limit to the speed they can run. Military troops have a limit to the distance they can march, for example, with a heavy pack load. Athletes have a limit of how long they can remain within a physiological envelope of control that allows them to maintain adequate resilience to injury. People often seek ways to extend their capabilities—to run faster, hike farther, jump higher, stay more resilient, etc. It would be desirable to extend people's capabilities and overcome some of their limitations.

It is known generally that a device can receive a force and store potential energy. Later, the device may be actuated to release the potential energy as kinetic energy. During dorsiflexion motion of the ankle and lower leg system of a user, force acts over a distance and potential energy is stored in a force/energy management system according to the several footwear embodiments described herein. The stored potential energy is then returned to the ankle and lower leg system as kinetic energy during plantar flexion motion. With the assistance of such force and energy, a person is less dependent upon internal muscles, flexor tendons and tendons for locomotion and stability. The person can perform better, experience less fatigue and be able to maintain an envelope of control which provides sustained resilience to injury, recuperate from lower limb issues faster and receive other health and performance benefits.

Gait Cycle

Human locomotion is driven by three major energy sources—the foot system, the knee system and the hip system. Each of these systems is moved by a combination of muscle force as well as tendon force. In a typical walking gait, roughly 40 to 45% of energy is provided by the foot system, which surpasses the individual contributions of both the knee and hip systems. As stride length or gait speed increases the relative contribution of the foot system decreases in relation to the knee and hip system.

During a gait cycle, as the term is used herein, the Achilles tendon stretches during dorsiflexion motion and releases during plantar flexion motion. The efficiency of the Achilles tendon is quite high, with laboratory measures showing a potential for a greater than 90% energy return. The Achilles is an elastomeric element that is capable of stretching up to 8% of total length under load before plastic deformation.

The use of powered exo-skeletons has been demonstrated in the laboratory; (reference may be made to articles cited in the attached bibliography, incorporated by reference herein as to any material deemed essential to an understanding of the principles of energy management disclosed herein). The use of powered exoskeletons for the ankles has been tested on the treadmill and showed to have potential to enable improved performance. These studies also show that managing the timing of the release of energy from these powered systems requires some learning on the part of the wearer. Proper harmonization of the device with the gait cycle is a necessity for a person to gain significant benefit.

Because of these tests, supplementing the foot system with support and added energy capability through an external system can be meaningful. A supplemental system can help athletes perform better. Such a system can help boost walking endurance; it can help people with ankle and Achilles tendon injuries recuperate faster and help avoid future problems. Also, it can help people walk more easily and with less fatigue. Such a system should also be timed correctly to harmonize with the proper need for energy.

Plane of Reference

Performance benefits that may be achievable using a supplemental system include improved speed, improved endurance, increased jump height, increased backpack loading, decrease in oxygen consumption, etc. A focus of such a system may be on the rotation of the ankle joint in the sagittal plane as a main source of force and energy.

Benefits may also be achieved by such a supplemental system in the frontal plane. In shoe structural design, the frontal plane may be utilized to maintain or extend a shoe's protective capabilities in the ankle and limit range of untoward varus or valgus motion in the ankle that may otherwise lead to sprain or other injuries.

Typical Biomechanics of the Human Ankle

A typical human ankle range of motion is commonly discussed in biomechanics literature with variations according to each authors' clinical experience; the following overview of the normal gait cycle is a simplified recounting of common literature.

The gait cycle may begin with the first touch of the foot to the ground. This first touch begins the cycle at 0% and the moment immediately prior to the following touch to the ground of the same limb may represent 100% of a cycle. In the normal walking gait, the ankle may experience a small amount of extension after initial contact leading to plantar flexion during the first 10-15 or so percent of the cycle, commonly referred to as a loading response. This is then followed by increasing amounts of dorsiflexion motion, which further increases after mid-stance. Maximum dorsiflexion is typically achieved after heel lift and prior to the initial contact of the opposite foot. This is followed by rapid plantar flexion motion associated with push off, which occurs after the opposite foot makes its initial contact. In the push-off phase, the ankle plantar flexes through toe off. This is followed by a swing phase with the foot traveling in the air. During the swing phase, the foot dorsiflexes to a neutral position preparing it for the next cycle.

For simplicity in writing of the patent, we will refer to ankle system motion during the periods of increasing flexion after initial contract and loading response, through mid-stance, through heel lift, to peak dorsiflexion as "dorsiflexion"; and we will refer to ankle system motion during the periods of increasing extension found during opposite foot contact through toe off as "plantar flexion".

The total range of motion in the ankle during a walking gait is the result of a combination of dorsiflexion angle and plantar flexion angle. After midstance, there is increasing dorsiflexion to a peak of 5 to 15 degrees as measured according to well known technical arts. During push off, the ankle rapidly plantar flexes to a peak of −5 to −20 degrees. Typical total range of motion during the normal walking gait is often shown as 20 to 40 degrees in common literature and internet resources.

Analyzing the running gait where a walking gait has been discussed above, we see similar elements of the cycle; however, efficient runners rarely land on their heels in order to prevent unnecessary losses in energy. Rather, initial contact is on the front part of the foot while the ankle is in slight dorsiflexion. The amount of dorsiflexion increases after midstance to a peak of 20 to 50 degrees. This is followed by rapid and powerful push off during which the ankle plantar flexes to a peak of −10 to 30 degrees. This results in a total range of motion of 40 to 70 degrees. Jogging gaits may range between the walk and run depending upon the person jogging, their abilities, the conditions, their level of exertion, etc. Sprinting gaits often show a decrease in range of motion when the athlete is near the top of their speed range.

Benefits of External Assistance During Dorsiflexion

When an ankle is in dorsiflexion phase, with a joint angle greater than zero, some amount of force needs to be applied to keep the ankle joint angle from rapidly increasing which would lead to the joint collapsing under the weight of the body. The removal or full rupture of the Achilles tendon and removal of other supportive ankle muscles & tendons, for example, would result in joint instability and the inability for a person to bear their body weight upon that foot. Any amount of dorsiflexion results in a necessary force being exerted in the ankle region to prevent joint collapse. A reduction in the force necessary to support the body during dorsiflexion phase, therefore, can be perceived as a potential opportunity to save energy or boost performance.

Several inventors have attempted to use differential forces above and below the ankle joint in the past to produce inventions that would be helpful to people. For example, Borden, U.S. Pat. No. 5,090,138, discloses a spring shoe device with a heel socket, shin brace, ankle hinge and spring strap. Stewart, U.S. Pat. No. 5,125,171, discloses a shoe with a spring biased upper. Frost, U.S. Pat. No. 5,621,985, discloses a jumping assist system with multiple components. A rather elaborate design is disclosed by Seymour, U.S. Pat. No. 6,397,496, for an article of footwear which employed multiple springs to assist motion of a boot in the upward direction.

A distinct limitation of the current art is that the elements do not appear to be successfully integrated into the upper or collar of a shoe such that human locomotion is improved, for example, with both an improvement in a rotation zone and an elastic zone. Furthermore, cuffs designed for going over the lower leg to the extent present in the art are not integrated into the aesthetics of common footwear.

The known technical art fails to simplify structural elements of a device above the ankle to receive force and transmit the force to a spring. Exemplary art may show a device which depends upon non-trivial collars that wrap the leg above the ankle, the bulk of which contributes to their inability to be effectively integrated into traditional footwear. Similarly, anchors below the ankle, to the extent depicted in the known technical art, are often shown as appendages and extraneous devices which may interfere with preferred shoe design techniques.

In view of the prior art, there is a need to minimize the complexity, cost, weight and materials used to enable an article of footwear to harvest energy from the lower leg.

Summary of the Structural Elements of the Several Footwear Embodiments

The embodiments of footwear described herein improve upon the known art of footwear design in many respects, including clever management of forces from the lower leg into a shoe using familiar shoe design approaches, tooling, materials and manufacturing approaches. An intention of the several embodiments and structural elements thereof disclosed herein (sandals excluded) is to create footwear with performance improvements integrated into the design, aesthetics, material selection and construction so that they can be successfully commercialized. Examples of prior art have relied upon appendages, additions and changes to footwear construction and material selection that have not reached commercial viability.

The several embodiments (sandals excluded) integrate their novel improvements in a way that enables the footwear to avoid being perceived as a contraption, and provides aesthetic shoe designers with a design palate that enables them to offer a wide range of ornamentally inspiring designs.

Force above the ankle is exerted predominantly by the pressure of the front surface of the lower leg upon a receiving device such as a tongue of a high top collar of a shoe or boot. To achieve an upward stretch of a tension spring in proximity to the Achilles, one must use some type of mechanism to change direction of the force from near-horizontal to near-vertical. Prior art examples typically relied upon cuffing of the lower leg, which can lead to discomfort, unnecessary size, unnecessary weight, and unnecessary banding forces around the perimeter which may unduly constrict motion of tendons, ligaments, blood flow, and the Achilles tendon itself. Collar mechanisms put unnecessary force upon the rear of the leg, which has no capability of delivering primary forces. The embodiments herein and aspects thereof demonstrate a variety of ways in which forces may be managed without undue cuffing forces, especially to the rear of the lower leg.

Bilateral Components in Depicted Footwear

It is assumed in the descriptions of embodiments and by the depictions thereof in the drawings showing but one side view herein that the user of skill in the art will be aware that many of the components mentioned are bilateral in nature, with both medial and lateral instances. As an example, there are typically two eyestays in each shoe, a medial eyestay and lateral eyestay. By assuming this knowledge, plural terms are not used herein and so eliminate the need for specifying medial and lateral instances of bilateral components.

To be clear, it is known in the art that bilateral components may not be mirror images or exact copies of each other. For example, the ankle joint is not horizontal to the ground, and the medial side is higher than the lateral side. Those skilled in the art will be able to still gain clear understanding of these teachings by limiting descriptive language to the singular.

Using Stretch of a Passive Energy Storage Device to Manage Energy

In powered external foot/ankle exoskeletons, motive force may be provided by pneumatic cylinders. In shoe embodiments described herein, a passive energy storage device is used to manage forces and energy external to the body. A passive device structural element of the several embodiments of a shoe as described herein may include a spring, elastic member, elastomeric component or other such device known in the art, particularly located according to the figures.

Thus, the several embodiments involve the storage and management of energy under tension. Tensile energy may be stored and released in any variety of commonly used formats, such as an elastic cord or multiple cords, coil spring, an elastic band, a bungee cord, a an elastomeric material, a woven cord, etc. Energy may also be stored in a planar or sheet surface. Sheet materials such as latex sheets, flat latex bands, rubber sheets, rubber tubes, woven fabrics, non-woven fabrics, etc can all apply force, store energy and release energy when tension is applied to them. Tensile energy may also be stored and released in custom-shaped or molded elastomeric objects such as a set of cords overmolded into a common element, or molded elastic elements that contour to the outside of a shoe or the rear of a foot, ankle and leg. Molding of rubber, thermoplastic rubber or urethane, silicones, and other elastomerics are common in footwear and can be applied herein.

A wide variety of shapes, a small number of examples which are described above, will henceforth be noted as tension springs. Reference to tension springs therefore will broadly address a variety of materials and shapes that can act in tension.

Benefits of Tension Spring Force/Energy Management During Dorsiflexion and Plantar Flexion During the walking gait cycle, the peak demand for ankle energy occurs after midstance as the ankle is in the process of increasing dorsiflexion and then rapidly plantar flexing. The transition of decelerating dorsiflexion motion to accelerating plantar flexion motion requires the contribution of the Achilles tendon and the soleus and gastrocnemius muscles as well as a variety of other muscles and connective tissues including tendons. The Achilles tendon can stretch up to 8% before plastic deformation.

While the Achilles tendon is a very efficient member, capable of returning more than 90% of energy stored within, associated muscle is not as efficient. Use of the muscle in the gait cycle is consumptive of energy. Literature shows that during the period of dorsiflexion, the ankle system consumes approximately 0.2 to 0.5 W/kg of power, while during the time of transition from dorsiflexion to plantar flexion the ankle system consumes roughly 2 to 4 W/kg of power.

By anchoring a tension spring to capture range of vertical motion or diagonal motion, as described below, one can impose a force during dorsiflexion which harvests energy for each degree of ankle rotation in the dorsiflexion direction. This externalizes force outside of the body and stores energy as potential energy.

By externalizing force and energy during dorsiflexion, several things are accomplished: reduce the amount of muscle force and energy required to manage dorsiflexion (and prevent the collapse of the joint) thereby reducing the power requirement, typically shown as 0.2 to 0.5 W/kg; reduce the total energy needed to be managed and stored by the tendons; and either reduce oxygen consumption assuming a steady gait or provide an opportunity for a more aggressive gait without additional oxygen demand. Similarly, the energy stored in the tension spring may be returned to assist in plantar flexion motion by applying force across a distance.

By converting the externalized potential energy into force that is internalized into the foot, several things are accomplished: reduce the amount of muscle force and energy required to manage plantar flexion (and provide forward gait propulsion) thereby reducing the power requirement, typically shown as 2 to 4 W/kg; reduce the total energy needed to be managed and stored by the tendons; either reduce oxygen consumption assuming a steady gait or provide an opportunity for a more aggressive gait without additional oxygen demand; and assist in a variety of other ankle mediated tasks, such as jumping, hopping, leaping, etc.

Simplified View of a Shoe System Involving Structural Elements of the Several Shoe Embodiments The structural elements of the several show embodiments disclosed herein exploit differentials between the foot system below the ankle and the leg system above the ankle. In order to perform mechanical work, a force is applied over a distance. Therefore, in order for the systems to work, we identify means for anchoring force-carrying devices so that force can be applied, and we identify means to harvest this force over a range of motion distance.

Simplified View Regarding Leg Force Below the Ankle

Forces are managed in the several depicted embodiments by establishing anchors integrally within footwear, for example, below the ankle and above the ankle of the wearer of depicted footwear.

Anchoring forces below the ankle is accomplished with the aid of an article of footwear. Because the foot is wrapped on many surfaces by an article of footwear, force can be transferred effectively and distributed broadly to ensure comfort.

Force carrying members, anchors and supplemental means of support into footwear of the several embodiments such that a shoe manufacturer or maker may maintain geometrical stability in the footwear and anchor, comfort to the user, adequate aesthetic appeal to the buyer, cost that is appropriate for the application, longevity commensurate with the application, lightness of weight, safety, among various other concerns necessary for a commercially viable product.

Simplified View Regarding Leg Force Below the Ankle

Anchoring forces in and out of the lower leg above the ankle is one aspect of the several show embodiments. Another is to apply the fore and aft force to the front face of the lower leg which may create a force to assist plantar flexion motion of the foot and conserve energy during dorsiflexion motion of the foot.

In addition to the fore and aft force applied to the lower leg, there are also other forces that act upon a lower leg device. In the several embodiments, a rotational force may be directed into lifting the heel of the user and driving plantar flexion. As such, there is an equal and opposite downward force on the lower leg which is managed. As this is a dynamic system which is also influenced by the accelerations based upon the knee and hip systems as well as environmental factors and the influence of human activity, various other forces will exhibit themselves throughout any given activity.

To integrate an adequate lower leg anchoring system within an article of footwear, the several embodiments and aspects thereof disclosed herein will use two approaches both independently and in combination within articles of footwear. Several terms need to be defined for clarification of the several embodiments.

Yoke—a yoke is defined for this application as a device which relies upon managing forces on three active sides through a "U" shaped configuration. Herein, the base of the "U" is positioned against the front face of the lower leg and is able to receive fore and aft forces. The lateral and medial sides of the "U" are positioned near horizontally above the malleolus ankle bulge and able to manage up and down forces through skin friction as well as interference with bony malleolus ankle bulge, as well as through integration with a pivot system in proximity to a rotation axis of the ankle. There may be a 4th side of a yoke device that connects the open legs of the "U", however, this side is often not responsible for carrying primary forces.

Collar—a collar is a band that constricts the outer diameter of an object it encircles. It can apply a vertical force on the leg through a combination of skin friction resistance as well as a mechanical force when the inner diameter of the collar is smaller than the outer diameter of the bony protuberances of the ankle it encircles.

Collar yoke—a combination of the U-shaped yoke together with a circumferential band or collar, the design of which can distribute primary forces, secondary forces and disparate other forces to specific areas of the device, as well as manage rotational and pivot forces.

Simplified View Regarding Range of Motion

To manage force and energy, the novel concepts herein integrate elements into footwear to establish anchor points and mechanisms which spread a tension spring further apart from plantar flexion to dorsiflexion as well as manage rotational and pivot forces.

There are two areas of expansion that the several embodiments may exploit (independently and in combination): 1) a range of motion vertically, roughly parallel to the Achilles, which is managed through employing a rotatable collar yoke that has a hinge point in proximity of the ankle joint and translates near-horizontal pressure force from lower front of the leg over a fulcrum and into a near-vertical force on a tension spring at the lower rear of the leg; and 2) a range of motion diagonally from shin to heel, which is carried by a collar lobe, yoke or collar yoke that can rotate and or move linearly forward and backward thereby transferring near-horizontal pressure force from the lower front of the leg to a near-diagonal force on a tension spring which is attached on its opposite side to an area that is above the top rear of a heel counter of a shoe.

Simplified View of Exploiting Range of Motion Vertically

To measure vertical expansion and contraction, one can place ink marks on the lower limb along the Achilles tendon. During the range of motion found in dorsiflexion and plantar flexion in a gait cycle, the distance between these reference points will vary by several centimeters. This change in distance is mediated by the combination of changes in length of several bodily members, including the Achilles tendon, the calf muscles including the soleus and gastrocnemius muscles.

This change in length of these major members is distributed over their combined working length, which in an adult can be over 35 cm in total length. External to the body, however, this change in distance between our two illustrative ink marker points on skin is not evenly distributed across this combined length. Inspection of the skin in the region of the Achilles tendon shows that the majority of stretching and compression of the skin surface is associated with a small region.

The region of the posterior face of skin over the Achilles tendon that is posterior to the ankle shows a high degree of skin stretch and compression. This region can be approximated in an adult as starting at 5 cm in height above the floor at an upright standing position and continuing up to 10 cm in height above the floor. The skin in this region is often wrinkled, showing the history of significant stretching and compression over years of use. We will henceforth refer to this area as the "creased skin region".

The creased skin region can be roughly described as a triangular or wedge shape. The axis of ankle rotation defines the anterior point of the wedge. Two imaginary lines emanate from the axis of ankle rotation to the anterior upper and lower limits of significant skin stretch and compression. By way of example, the upper line may be roughly 5 cm in length and the lower line may be 6 cm in length. The imaginary near vertical 5 cm line between these two points define the hypotenuse of the triangle. Skin will stretch and compress outside of this region, but the majority of skin stretch and compression is observed in this region.

To illustrate the potential for range of motion across the creased skin region, one can imagine that this region may be measured at 5 cm in length as measured along a vertical axis when standing upright and still. During dorsiflexion, this length may stretch to 7 cm or more in length. During plantar flexion, this length may compress to 3 cm in length or less. This results in a range of linear expansion/contraction total of 4 cm or more.

Enabling Vertical Range of Motion

Unfortunately, there is no convenient physical bodily feature upon which to directly anchor a force carrying object to the rear face of the lower leg above the creased skin region. A feature of the embodiments herein is to enable such functionality in footwear.

One approach is to cuff the lower leg, such that the cuff stays stable on the lower leg and provides a means for anchoring a mechanical attachment at the back of the cuff.

Various collar mechanisms were experimentally fitted around the lower leg to determine the ability for using cuffs that impinged upon the protrusions of the ankle (lateral & medial malleolus) as a way to keep the cuff stable and manage downward force. Examples of this type of cuff are seen in gymnastics grips which use the bulge of the wrist bones as a means for anchoring hand grips. Gymnastic grips can manage over a thousand Newton, leading to a hypothesis that a similar collar around the lower leg could manage similar forces.

It has been experimentally determined that a tight collar around the ankle could easily support a large amount of force, but that the application would also be influenced by the duration of use and the amount of discomfort accepted by the user. The higher the force, the higher the discomfort. Cuffs that are unusually large may distribute forces more broadly, but may not enable required footwear performance or be aesthetically acceptable. There is also an issue of interference with the rear tendons of the lower leg. The nature of a collar is to constrict an object within its diameter. If an object that is being encircled by a collar has a protuberance, it will receive a greater amount of the collaring force. As such, collars placed immediately above the malleolus tend to place a significant amount of force on the Achilles region, leading to discomfort, abrasion and pressure points. This is worsened by the ongoing cycle of stretching and relaxation of the Achilles which can allow the collar to seat itself each time the tendon is relaxed and then constrict when the tendon is in tension.

Gymnastic routines upon rings or bars last only a matter of one or two minutes, enabling the athlete to tolerate discomfort in exchange for the benefit offered from improved performance. Similarly, specialty footwear applications in which users can accept discomfort for a brief time may allow the disclosed embodiments to apply significant collaring forces above the malleolus. However, for the majority of applications, users will desire a solution which is comfortable over the duration of the time the footwear is worn using a sufficiently small collar arrangement to properly integrate with their footwear. As such, the amount of downward force that can practically be managed by collaring above the malleolus should be limited.

Since there is a practical limit of the amount of force that can be managed through collaring forces above the malleolus ankle bulge, there is an unmet need to supplement or replace collar based force management. Other mechanisms have been considered in the past that employ garters around the upper calf, knee area and even the hip area. As these have never been successfully commercialized, these are considered impractical. Other mechanisms have been considered which employ a very large cuff around the ankle as common with orthopedic braces. These too have never been adopted into the footwear market and are considered impractical.

An approach to exploit vertical range of motion taught herein is to integrate into footwear an articulating member which enables forward motion of the lower leg into a yoke-based device that is then transferred over a fulcrum to enable a vertical force and motion upon a spring.

A yoke or collar yoke arrangement is described in several embodiments which enables management of primary forward leg force from contact with the lower leg, pivot force from contact with a fulcrum point in proximity to the ankle joint, and downward force from contact with a spring element. Additionally, features are discussed which enable the system to have sufficient stability against secondary forces to maintain viability within the application and within aesthetic and other design limitations.

In particular, an open yoke sandal embodiment demonstrates that force carrying efficacy within footwear can be accomplished without unnecessary cuffing or collar forces. This enables function of the system without unnecessary pressure on the skin in the Achilles region. The integration of a yoke into a collar to produce a collar yoke is another novel concept. In this manner, primary forces from the lower leg can be managed through the yoke functionality within a collar. This enables management of significant primary force and ensuing torsional forces over the pivot without at a high degree of banding force of the collar. As such, significant force can be managed at the front of the lower leg without unnecessary pressure upon the Achilles tendon area at the rear surface of the lower leg. The benefits of a banded high collar for aesthetics, management of untoward varus and valgus motion in the ankle, management of environmental forces and other protective benefits may be maintained. The length of the side walls of the yoke members may also be slightly elongated to the rear, thereby creating an eccentric (i.e.: oval) shape to the collar, which can reduce the banding upon the rear of the lower leg.

Simplified View of Exploiting Range of Motion Diagonally

As described below, a region superior to the ankle joint that extends diagonally from the front face of the lower left to the top of the heel can experience a change in diagonal length of 2.5 cm or more during a gait cycle. By applying an external tension spring in this region, we can store and return significant energy.

To measure diagonal expansion and contraction, one can place ink marks on the lower limb along the base of the shin as well as the bottom of the creased skin region along the Achilles tendon. During the range of motion found in dorsiflexion and plantar flexion in a gait cycle, the distance between these reference points will vary by several centimeters.

This change in distance is relative to the elevation of the front anchor point. If the superior anchor point is placed at the base of the shin all the way down to an elevation level with the horizontal plane of the ankle joint, there is only minimal change in distance between it and the inferior anchor near the heel.

As the superior anchor point is elevated along the base of the shin, the change in distance between dorsiflexion and plantar flexion can reach over 2 cm. Common high top basketball shoes reach up 16 to 18 cm off the floor. Assuming that the horizontal plane of the midpoint of the ankle joint (which is not level to the ground) is roughly 11 cm off the ground, one can visualize that the top of the front of a common high top collar or tongue reaches 5 to 7 cm above the ankle joint elevation.

Thus, by establishing a superior anchor point near the top of the front of a high top collar and the inferior anchor point above the heel counter of a shoe, that there is an opportunity to observe a 2 cm or more change in distance across dorsiflexion and plantar flexion.

Spring Design and Geometry

As mentioned above, springs of a variety of materials and shapes may be utilized in the several embodiments. Springs may also be designed in parallel with other materials, such as straps or stiffer springs, which can limit range of motion. In doing so the spring may stretch out to a certain extent and then be limited by the other material. This may help prevent untoward motion.

The geometry of the device within a shoe will also determine the starting point at which the force may be exerted. This geometry will establish the range of motion in which the spring is not yet active and the range of motion in which the spring or springs are active. For example a geometry can be constructed to be helpful to people who do not wish their shoes to induce plantar flexion angle beyond neutral—for example people with limited ankle strength. Spring force would increase linearly in dorsiflexion from 0 to 30°, but there would be no spring force in plantar flexion at less than 0°. For example, a walking shoe may benefit from having spring force linearly increase starting at −5° and ranging to 25 or 30°.

Or, for example, a person engaging in an athletic sport may wish to have spring force start at minus 20° and increased linearly through positive 40°. This would tend to position the foot in a plantar flexion position during the swing phase and help the athlete maximize the amount of energy storage at each step. The spring force could also be designed non-linearly so that there is a light spring force from minus 20° to 0°, and then an increased spring force from 0 to 40°.

Varying Spring Force with Shoe Size

The several embodiments disclosed herein may be of benefit to people of all shoe sizes. While there is no direct correlation between shoe size and body weight of any given individual, one can make a generalization across the population that body weight increases with shoe size. Therefore, the larger the shoe, the higher the spring rate designed into the system.

Increase in body weight will benefit from an increase in spring rate. A linear progression will enable this adjustment, for example Spring Rate=Design Factor×Shoe Length. For example, a Design factor of 1.2 N/cm2 for a 16 cm Foot Length will yield a 19.2 N/cm Spring Rate for a shoe size that is roughly 8.5 in US sizing; while the same Design Factor of 1.2 N/cm2 for a 20 cm Foot Length will yield a 24 N/cm Spring Rate for a shoe size that is roughly 13 in US sizing. Design factors will be different for adult ranges of sizes versus youth ranges of sizes.

Comfort is limited by undue pressure. Correlating spring rate linearly to foot size can help ensure that pressure is also managed properly. Pressure upon the front face of the lower leg is calculated as a function of the surface area of the yoke face upon the lower leg, which nominally equals lower leg width times yoke breadth. Assuming that lower leg width is nominally associated as a linear function of foot size across a population, and that the breadth of the yoke will increase linearly with foot size, then the available surface area will increase geometrically with foot size. This increase in yoke surface area will accommodate a linear correlation of spring rate to foot size, assuming that the Design Factor is maintained nominally between 1 and 2.

Timing

Studies using powered ankle exoskeletons showed that the timing by which power was delivered from the exoskeleton into the ankle system was a significant variable in determining the performance of the wearer. Improper timing led to poor performance and proper timing required conscious effort by the user.

Similarly, in many heel-based energy management systems, energy can be absorbed upon initial contact of the heel to the ground, but the timing of the return of energy can impact resulting performance. The return of energy out of a heel based spring/cushion system is often delivered too quickly to be of significant performance benefit to the user.

A feature of the embodiments disclosed herein is in their ability to harmonize force/energy capture and energy return with the wearer's gait cycle. Proof-of-principle experiments with rough prototypes show an improvement in performance which exceed initial estimates. One hypothesis for this unanticipated benefit is that the force/energy management systems disclosed herein have functionality which is similar in behavior to internal tendons, and so can complement their activity synchronously throughout all of dorsiflexion and plantar flexion as well as rotation.

BRIEF DESCRIPTION OF THE DRAWINGS

FIG. 1A is a side view of footwear of a first embodiment showing structural elements including a rotatable collar yoke and an anterior and posterior gusset forming a channel and an elastomeric overlay for storing and providing energy during locomotion use and FIG. 1B is a rear view of the first embodiment of FIG. 1A. FIGS. 1 through 7 show the first embodiment of footwear with a rotatable collar yoke and anterior and posterior gussets in further detail.

DETAILED DESCRIPTION OF THE DRAWINGS

First Embodiment

Rotatable Yoke with Vertical Tension Spring

Figure 4A:
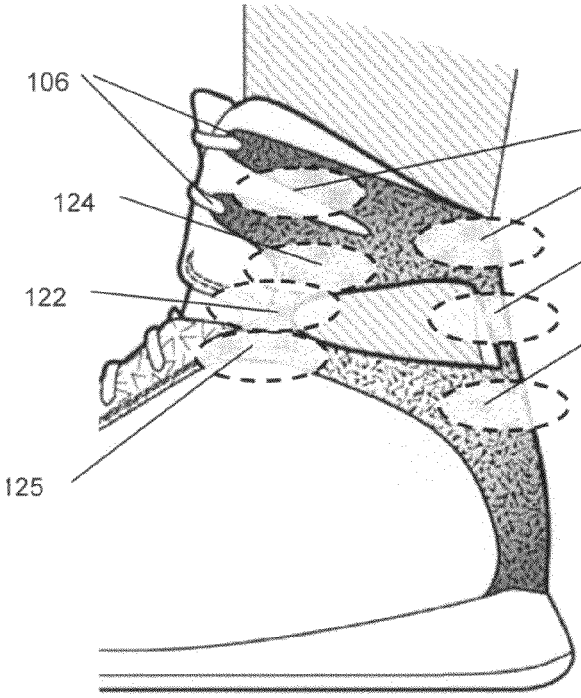

Table of Reference Numerals first embodiment of the shoe 100
outsole 101
midsole 102
heel cushion area of the midsole 103
rotatable collar yoke 104
laces 105
yoke eyelets 106
tongue 107
upper 108
eyestay 109
counter panel 110
eyestay stitching 111
counter panel stitching 112
"X" shaped stitching overlap 113
anterior gusset 114
posterior gusset 115
narrow channel of upper 116
interface between midsole and upper 117
leg 118
stitching in the rotatable collar yoke 119
elastomeric overlay 120
elastic zone 121
rotation zone 122
collar yoke adhesion zone 123
superior rotation anchor zone 124
inferior rotation anchor zone 125
superior elastic anchor zone 126
inferior elastic anchor zone 127
zones of reduced bonding agents 128
heel counter 130
collar yoke stiffener 131
collar yoke stiffener rotation interface 132
eyestay and collar stiffener 133
eyestay and collar stiffener rotation interface 134
upper stiffener 135
lace routing 136
sock liner and padding system 137
tension-bearing stitching 138
collar yoke cantilever 139
variation of eyestay and collar stiffener 140

Figure 4B:
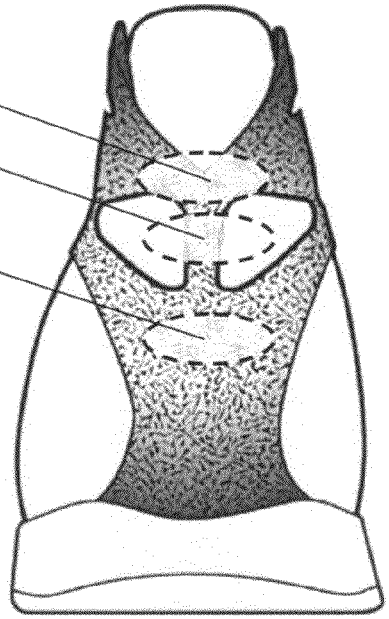
Figure 5A:
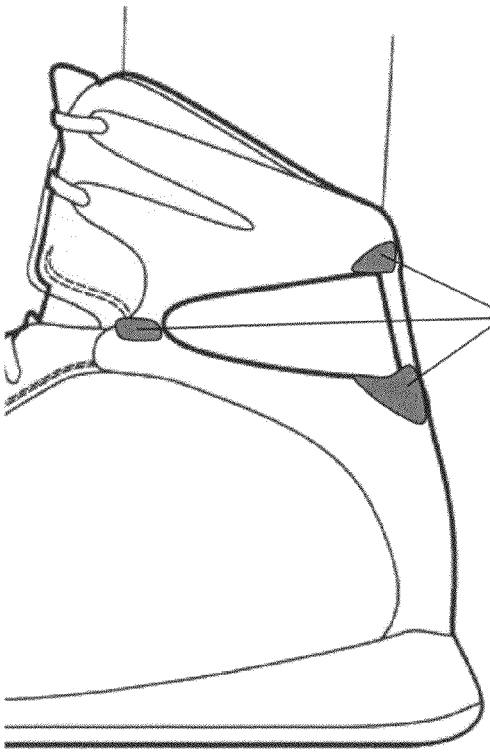
Figure 5B:
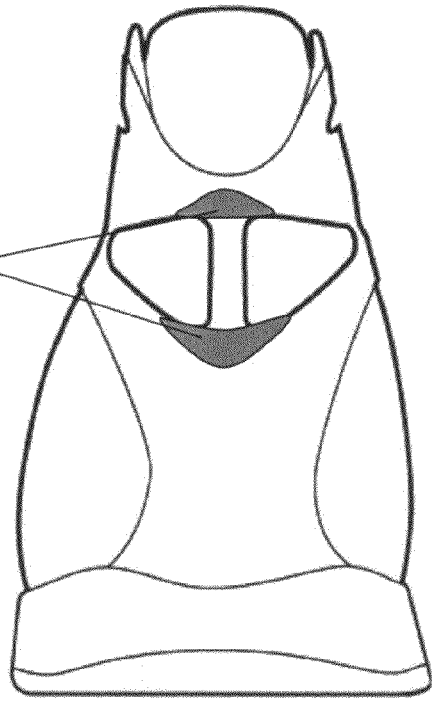
Figure 7A:
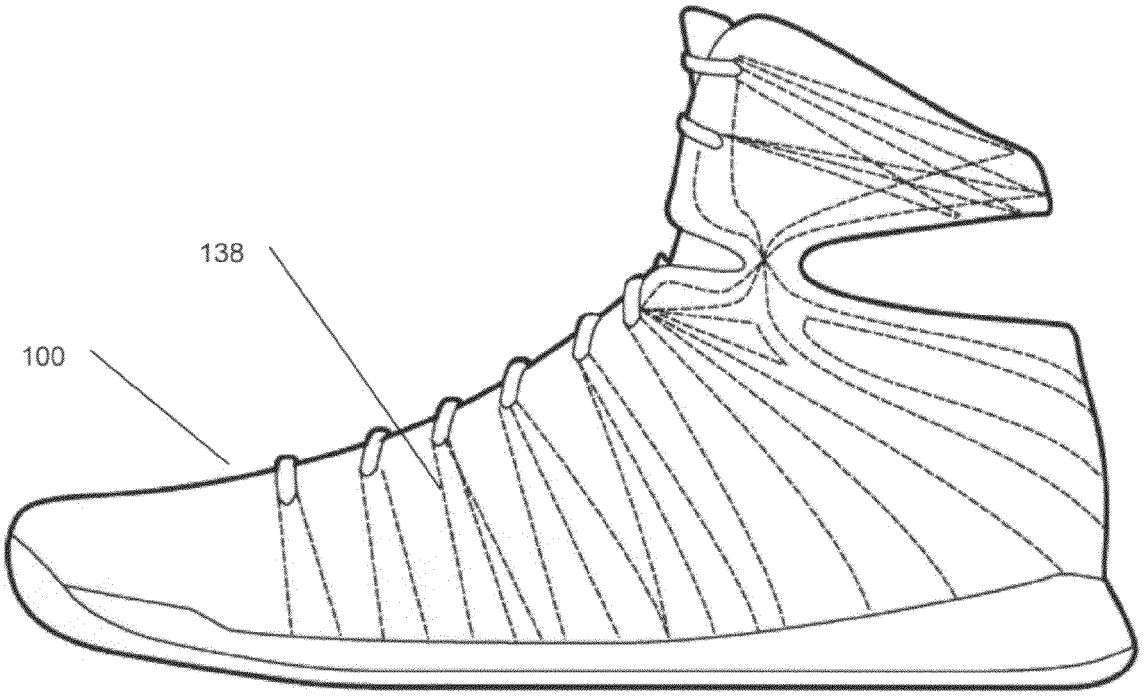
Figure 7B:
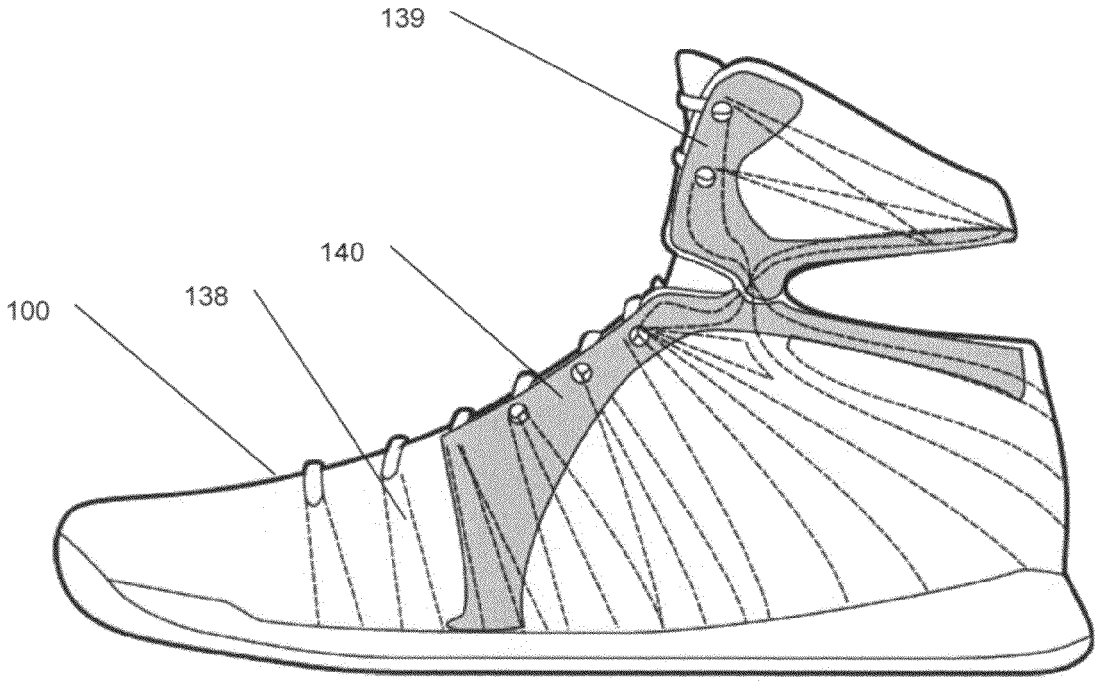
Figure 8:
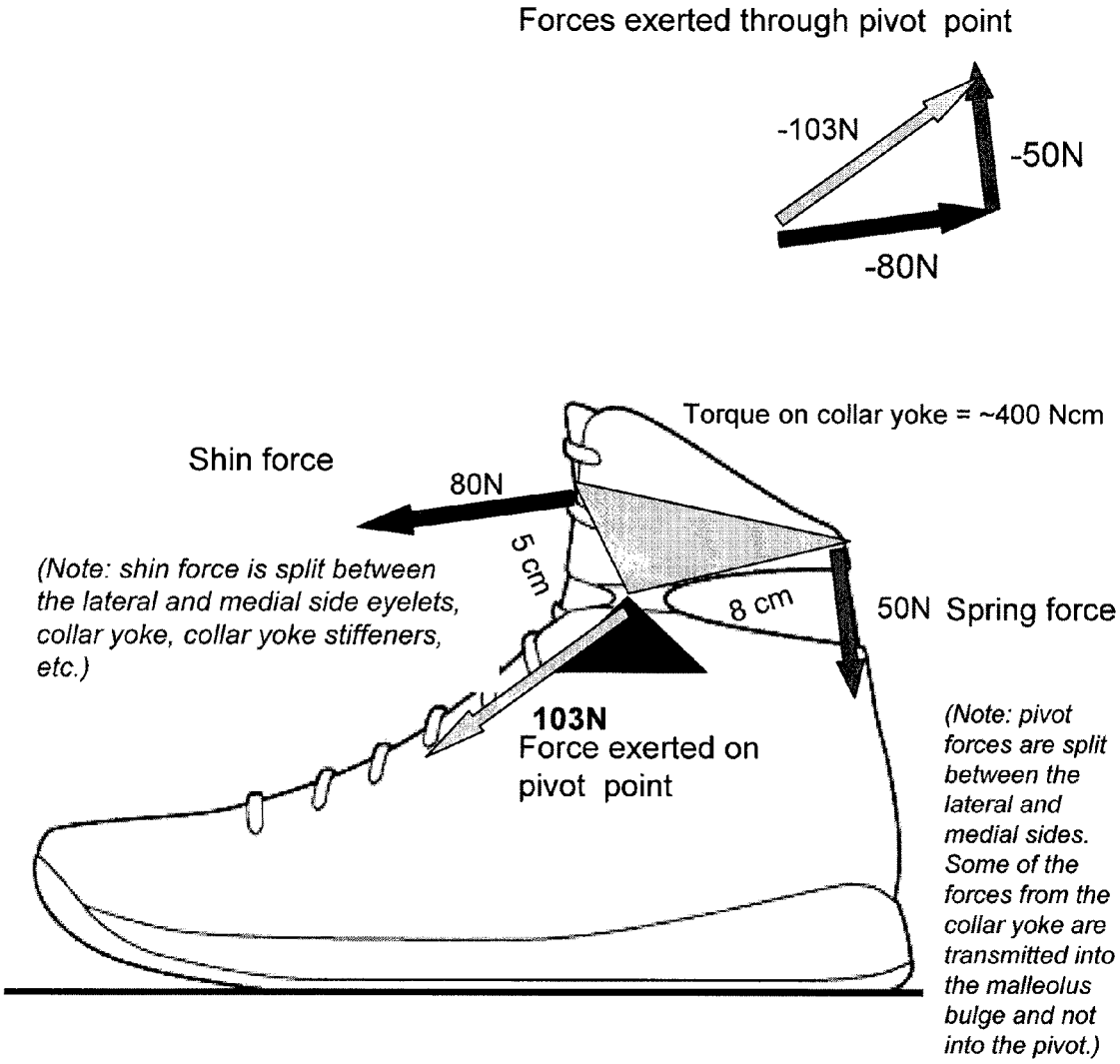
FIG. 8 shows a hypothetical diagram of forces applied to one side of the first embodiment.

Referring to FIGS. 1 through 7, various side (A) and rear (B) views of a first embodiment of footwear, for example, a shoe are shown from one perspective, for example, a left shoe 100 where a side of the shoe 100 not seen is assumed to be similar to the depicted side. FIG. 1A shows an external side view and FIG. 1B a rear view of the first footwear embodiment. FIG. 4 shows a close-up of an ankle housing portion of shoe 100. FIGS. 2, 3, and 6 show side (A) and rear (B) views of the first embodiment with varying layers of materials removed to reveal internal components. FIG. 5 shows details concerning the placement and removal of bonding agents, and FIGS. 7A and 7B show details of tension-bearing stitching 138 or caging and a collar yoke cantilever 139 (FIG. 7B). FIG. 8 will be referred to for a discussion of vectors for spring force, force exerted on a pivot point and shin force in the vicinity of a narrow channel 116 for the first footwear embodiment.

FIGS. 1 through 7 are drawings, for example, of a modified high top athletic shoe 100, with a rotatable collar yoke 104 and elastomeric overlay 120. Shoe 100 may have an articulating joint at narrow channel 116 and an overlay rotation zone 122 as well as a tension spring device which is managed within an elastic zone 121 (FIG. 4).

The posterior gusset 115 may remain exposed to highlight the dynamic quality of the shoe, or it may be covered by a stretch fabric to provide an aesthetic shoe designer with styling options and to prevent entry of sand and debris. Shoe 100 does not suffer from negative aesthetic impact of appendages or ancillary equipment. It can thereby maintain appearance qualities similar to other high top athletic shoes and offer an opportunity for delivering appealing ornamental designs that engage and interest buyers.

Basic Construction and Functionality

FIG. 2 shows shoe 100 with the elastomeric overlay 120 removed in side view FIG. 2A and rear view FIG. 2B. These views demonstrate that a common high top athletic shoe may be modified to incorporate a point 113 of a narrow channel 116 (FIG. 3) as will be described further herein. Shoe 100 has an anterior gusset 114 as well as a posterior gusset 115. The addition of a posterior gusset 115 creates a narrow channel 116 of upper 108 between the anterior and posterior gussets 114, 115. Channel 116 defines a section above channel 116 which is formed as a rotatable collar yoke 104. The narrow channel 116 and point 113 thus may be a pivot point for forces as discussed herein.

Collar yoke 104 may have a set of yoke eyelets 106 through which pass a set of laces 105. Force from a lower leg 118 of a user can pass into a tongue 107 and then into the laces 105 and then into the eyelets 106 during use. A person wearing such a pair of shoes may notice the ability for the rotatable collar yoke 104 to follow the motion of their lower leg 118 above the ankle joint and the ability for the main body of the shoe 100 below the narrow channel 116 to follow the motion of their foot.

Force from the lower leg 118 may create rotation in the collar yoke 104. Rotation of the collar yoke 104 may create a vertical range of motion at its rear. The vertical range of motion is visible at the rear opening of the posterior gusset 115. This vertical range of motion creates an opportunity to insert a tension spring of various forms as further described below and mimic and supplement the behavior of the Achilles tendon.

The geometry of collar yoke 104 may be designed to allow the user to adjust firmness of laces 105 to determine the comfort on the collar aspect of the collar yoke 104. The side walls of the collar yoke 104 may have stiffness which creates an additional length and oval shape to the collar yoke 104 than found in traditional collars. This results in less pressure being exerted upon the front and rear face of the lower leg 118 when the collar yoke 104 is tightened.

Shoe 100, as will be discussed herein is capable of managing forces, storing and returning potential energy, capable of transmitting these forces into its anchor points, be durable, be comfortable, utilize commercially viable materials and manufacturing processes, have aesthetic qualities which positively differentiate it compared to similar shoe offerings, and provide other advantages as well. A footwear system represented by shoe 100 may endure secondary forces associated with the environment and activity the footwear is employed for and withstand thousands of gait cycles across a 10 to 50 degree or more range of ankle motion. An elastomeric overlay 120, as described below, is one structural aspect of shoe 100 that is fully capable of fulfilling these requirements.

Overlay 120 Details

As shown in FIGS. 1 and 4, shoe 100 may be constructed with use of an elastomeric overlay 120. Overlay 120 may be, for example, a molded elastic element that contours to the shoe 100 and, referring to FIGS. 4A and 4B, shoe 100 has seven major functioning zones: an elastic zone 121, an overlay rotation zone 122, an inferior elastic anchor zone 127, a superior elastic anchor zone 126, an inferior rotation anchor zone 125, a superior rotation anchor zone 124, and a collar yoke adhesion zone 123.

Overlay 120 may separate the several functioning zones into several discrete components differentiating shoe 100. For example, elastomeric overlay 120 may comprise three separate overlays (not shown), with a bilateral set of rotation components 122, 124, 125, a bilateral set of collar yoke adhesion zones 123, and a set of elastic components 121, 126, 127.

Elastic Force Management

Referring to FIG. 4, elastic zone 121 is responsible for managing forces and storing a significant portion of the potential energy. Zone 121 runs near parallel to the Achilles tendon of a user of shoe 100. Like the Achilles, zone 121 is stretched in dorsiflexion and collapses in plantar flexion. The length, thickness, material selection, manufacturing process and attachment qualities of the elastic zone 121 determine its spring rate and damping qualities. These qualities can be adjusted by a manufacturer to meet the anticipated needs of a given footwear application.

The initial spring length provided by elastomeric overlay 120 is also influenced and controllable to a limited extent by the user and how tightly the user ties laces 105. If the user does not tie laces 105, as is frequently done by many people, elastic zone 121 may be rendered inoperative.

Elastic zone 121 is anchored below by an inferior elastic anchor zone 127. The inferior elastic anchor zone 127 provides a lower attachment point for the elastic zone 121 as well as a surface area for adhesion to the rear of shoe 100. Anchoring of elastic zone 121 may be accomplished by attachment to several components, including the external surface of the heel counter panel 110, sandwiched between the heel counter panel 110 (FIG. 2) and the rear of the shoe 100, the heel counter 130 (FIG. 6), the rear of the outsole 101 which may be connected via a contiguous molding, or alternate locations selected by the manufacturer. Fastening the inferior elastic anchor zone 127 to the rear of shoe 100 allows force from elastic zone 121 to be transmitted into the heel counter region which provides a mechanically advantageous means of inducing extension of the foot towards plantar flexion.

Referring again to FIG. 4, elastic zone 121 may be anchored above by a superior elastic anchor zone 126. The superior elastic anchor zone 126 may provide an upper attachment point for the elastic zone 121 as well as a surface area for adhesion to collar yoke 104 of shoe 100. Adhesion of the superior elastic anchor zone 126 to collar yoke 104 allows force to be transmitted from the leg 118, into shoe tongue 107, into laces 105, into yoke eyelets 106, into collar yoke 104, into superior elastic anchor zone 126, and then into elastic zone 121.

Rotation Force Management

Continuing to refer to FIG. 4, zone 122 of the overlay 120 enables proper rotation of the collar yoke 104, offers fulcrum qualities similar to a ball joint and is referred to herein as an overlay rotation zone 122. This rotation zone 122 sits on top of narrow channel 116 of upper 108 that connects the main body of shoe 100 and collar yoke 104. Flexibility in channel 116 enables collar yoke 104 to rotate in the sagittal plane. The overlay rotation zone 122 supplements channel 116, providing improved management of forces, reduction in buckling, reduction in slumping, higher force management capability and higher longevity. Overlay rotation zone 122 provides an additional layer of material on top of the shoe's typical construction material (i.e.: vinyl, leather, fabric, etc) to withstand the forces of torque, compression, shear and tension associated with repeated rotation of collar yoke 104. The overlay material of rotation zone 122 can function similarly to a human joint capsule by maintaining opposing joint surfaces in proper geometric position, enabling rotation, enabling a small amount of fore/aft joint laxity as in the ankle, and preventing untoward motion.

Overlay rotation zone 122 is anchored below by an inferior rotation anchor zone 125. The inferior rotation anchor zone 125 provides an attachment point for the bottom of overlay rotation zone 122 as well as a surface area for adhesion to upper 108. Adhesion of the inferior rotation anchor zone 125 to shoe 100 allows force from overlay rotation zone 122 to be transmitted into upper 108 and associated eyestay 109 of the shoe 100. The inferior rotation anchor zone 125 may extend along the bottom opening of posterior gusset 115 and may extend down eyestay 109 as well as down upper 108. This ability to distribute force among various shoe components provides a mechanically advantageous place to enable overlay rotation zone 122 to manage multiple forces. While in use, when elastic zone 121 of the elastomeric overlay 120 (FIG. 1) is managing forces, these forces are counterbalanced by overlay rotation zone 122 working together with narrow channel 116 of upper 108, which, in turn, are delivered into shoe 100. The forces from overlay rotation zone 122 apply a force vector that is directed nominally down and to the front as received by inferior rotation anchor zone 125.

The overlay rotation zone 122 is anchored above by a superior rotation anchor zone 124. The superior rotation anchor zone 124 provides an attachment point for the top of overlay rotation zone 122 as well as a surface area for adhesion to collar yoke 104. Adhesion of the superior rotation anchor zone 124 to collar yoke 104 of shoe 100 allows force from the overlay rotation zone 122 to be transmitted in and out of collar yoke 104 during use. In order for forces to be most effectively transmitted from a user's leg 118 to elastic zone 121 during use, they first receive leverage through the fulcrum defined by the overlay rotation zone 122. The superior rotation anchor zone 124 applies forces from collar yoke 104 into overlay rotation zone 122. The superior rotation anchor zone 124 may be geometrically designed to ensure proper bonding to collar yoke 104, proper force transmission from the collar yoke 104 into the overlay rotation zone 122, and reduction in buckling or slumping of collar yoke 104.

Collar Yoke Force Management

Continuing to refer to FIG. 4, zone 123 of the overlay 120 is referred to herein as a collar yoke adhesion zone 123. In the embodiments, the collar yoke adhesion zone 123 provides multiple benefits. Together with the collar yoke 104, zone 123 provides supplemental force carrying ability among the eyelets 106, the overlay rotation zone 122 and elastic zone 121. Zone 123 also provides supplemental rigidity to collar yoke 104 to minimize slumping or buckling of the collar yoke's constituent parts under load. Zone 123 provides aesthetic differentiation and can be configured to enable a limited amount of elasticity and thereby offer an amount of energy storage and return.

Overlay Materials

Each of the zones of the elastomeric overlay 120 described above may be comprised of the same, different elastomeric constituents or constituents of varying composition. For example, the elastic zone 121 may have a softer durometer and increased stretch as compared to the collar yoke adhesion zone 123. This can be accomplished by using a common substrate and varying the thickness, durometer, curing qualities, and other parameters as known in the art or by using a variety of different substrates in different locations of the same overlay 120, such as thermoplastic rubber, thermoplastic urethane, silicones, and the like.

Eyestay 109 and Sidewall

FIG. 2 shows a view of the exterior surface of the shoe 100 with the elastomeric overlay 120 removed. An eye stay 109 is incorporated around the eyelets 106, and then horizontally rearward under channel 116 (FIG. 3) until it is locked, for example, with the heel counter panel 110.

The eyestay 109 provides natural rigidity to shoe 100. As forces from rotation zone 122, inferior rotation anchor zone 125, and channel 116 are passed into eyestay 109, these forces can be spread across a greater area so that comfort can be maintained on the user and the longevity of shoe 100 can be maintained.

Forces into eyestay 109 from the rotation zone 122, inferior rotation anchor zone 125, and channel 116 during use are predominantly downward and forward and, as such, can be managed in multiple ways. Some of the force may travel down eyestay 109 into upper 108 and into sole 101, 102. Some of the force may be transmitted into the eyelets 106 and into laces 105 and into tongue 107, especially below anterior gusset 114. These forces are suspended along the top surface of the foot, travel through the foot and consequently into the midsole 102 and outsole 101. A sidewall is generally considered a side panel of upper 108. Sidewalls often hold aesthetic adornments such as shoe logos and may also be used to provide rigidity and structural stiffness to shoe 100. Sidewalls may be reinforced by caging or tension-bearing stitching 138. Some of the force may travel through the rigidity of upper 108 and sidewall allowing compressive forces to reach the sole 101, 102 without passing through the foot during locomotion.

Usage of stiff materials for upper 108, sound stitching, inclusion of lines of tension-bearing stitching 138, for example, between eyelets 106 and midsole 102, or the usage of supplemental external materials to create a cage are mechanisms that may be applied to increase the structural strength and force carrying capacity of the sidewall of upper 108. As such, applying these techniques will improve force transmission from the overlay rotation zone 122 and channel 106 through eyestay 109, through heel counter panel 110, and directly into upper 108.

Upper 108

FIG. 3 shows a view of the exterior surface of the shoe 100 with the elastomeric overlay 120, eyestay 109 and heel counter panel 110 removed. These side and rear views allow a view of details of upper 108, which in this embodiment may be a continuous piece of sheet material that flows through the narrow channel 116 and into the collar yoke 104. FIG. 3 may demonstrate that traditional shoe construction can be easily applied.

Stitching Overlap

FIG. 2 shows detail of eyestay stitching 111 and counter panel stitching 112. In this embodiment, narrow channel 116 (FIG. 3) is further reinforced by intersection of stitching 119 that results in an "X" shaped stitching overlap 113 forming a point at the intersection. This "X" shaped stitching overlap 113 may be created by overlapping eyestay stitching 111 with counter panel stitching 112, or may be created by independent stitching path construction where the stitching acts similarly to the cables of a suspension bridge. By locating the intersection of stitching overlap 113 in narrow channel 116 and overlay rotation zone 122, strength against tension and shear are provided while still allowing a range of rotation motion during use.

A stitching overlap may be created with the intersection of tension-bearing stitching used in some high performance athletic shoes. FIG. 7A is a representation of an application of paths of tension-bearing stitching 138 configured to maintain stability of shoe 100, support upper 108 of shoe 100 from slumping below narrow channel 116 and provide an ability for narrow channel 116 to pivot while maintaining integrity. In this approach, four parallel rows of "S" (and reverse "S") shaped paths of tension-bearing stitching 138 are curved and overlap at a common "X" point 113. A similar effect can be created with various other combinations of straight lines and curved lines intersecting at a desired point of rotation where the lines comprise stitching, tension-bearing stitching 138, caging and the like.

Gathered Material in Channel 116

The material used in construction of upper 108 may pass through narrow channel 116 in a flat manner The material may also be gathered in a manner that creates at least one crease in the material that is generally oriented horizontal to the floor. Those familiar with fabrics will be familiar with the process of gathering. The stitching overlap 113 can then be applied over top of the gathered fabric. By gathering the fabric, the overlay rotation zone 122 is provided with additional range of rotation motion.

Many shoes are created with multiple layers of materials. In shoe 100, some layers may pass through narrow channel 116 flat, while some layers may include gathering depending on the application of shoe 100.

Supplemental Material in Channel 116

To add further support and longevity in narrow channel 116, additional materials may be integrated with the materials used for constructing upper 108. For example, a small patch of fabric may reside between the outer surface material of upper 108 and the liner material. This additional material may include a variety of fabrics, for example, one way stretch fabric, two way stretch fabric, fabrics containing high strength materials such as para-aramid fibers, or other fabrics known in the art. The additional material may be bonded to upper 108. The additional material may simply be integrated into upper 108 by virtue of attachment through stitching overlap 113. The additional material may lay flat or be gathered in narrow channel 116. The overlay may also be supported in rotation sone 122 in other ways, for example, by encircling narrow channel 116 and overlay material of rotation zone 122 with material (for example, multiple wraps of thread, ribbon, elastomeric material, as one might wrap an eyelet to a fishing rod).

Supplemental Stiffeners

FIGS. 6 and 7 show supplemental stiffeners. The use of supplemental stiffening is common in sneaker construction. The technique may be applied, for example, in the creation of heel counter 130. The use of supplemental stiffeners can be implemented in various ways. Following traditional design of heel counters 130, stiffeners made of plastic sheet are sandwiched between a sock liner and padding system 137 and upper 108. Force may be transferred to a supplemental stiffener indirectly through a layer of upper 108 or sock liner and padding system 137 during use. It may also be transferred into and out of a supplemental stiffener by providing direct fastening between elements of an elastomeric overlay 120 and supplemental stiffener.

Tension, torque, compression, shear and other forces across a collar yoke 104 can distort the collar yoke 104 during use. While a collar yoke 104 made from multiple layers of sturdy sheet materials such as leather or similar materials may be able to withstand slumping or bending without reinforcement, many shoe designs do not have such stiff materials and are likely to bend, slump or otherwise deform under pressure. This deformation may prevent the range of motion found in a particular application to become usable. Therefore, shoes without sufficient strength in upper materials may require reinforcement in order to maintain their shape and longevity. The nature, required rigidity, required materials and require design are based upon the spring rates and forces designed into the footwear system of the first embodiment. A collar yoke stiffener 131 (FIG. 6) may be responsible for assisting proper force transfer within and across collar yoke 104 while also protecting collar yoke 104 from slumping, buckling or otherwise losing its intended and comfortable shape.

Referring now to FIG. 8, shoe 100 is shown to have multiple forces acting upon it during locomotion. The forces shown in this drawing comprise primary forces associated with the force/energy management of shoe 100. Other forces associated with routine use of shoe 100 are acknowledged but not shown here to help ensure clarity. These primary energy management forces include a spring force, a shin force and a force exerted on the pivot point (the vicinity of channel 116). Shin force is a force associated with the front face of the lower leg 118. Spring force is a force generally parallel to the Achilles tendon associated with the elastic zone 121 and elastomeric overlay 120. The force exerted on the pivot point is associated with the forces through narrow channel 116 and overlay rotation zone 122. Hypothetical dimensions of collar yoke 104 are shown in FIG. 8 to be a moment arm of 5 cm between the pivot point and the shin force, and 8 cm between the pivot point and the spring force. A spring rate in the elastic zone 121 of 25 Newton/cm can lead to a spring force of 50 Newton as a result of a 2 cm stretch of elastic zone 121 while the ankle is near maximum dorsiflexion. A 50 Newton force assuming a moment arm of 8 cm leads to a torque of 400 Newton-cm on the collar yoke 104. Knowing that there is a lateral and medial side of the collar yoke 104, and assuming a moment arm of 5 cm to the eyelets 106, there is an approximate force of 40 Newton to the lateral eyelets 106 and 40 Newton to the medial eyelets 106, resulting in a collective shin force of 80 Newton. There is also a force upon the pivot point of 103 Newton that is oriented down and forward, nominally along eyestay 109. The geometry of such a force/energy management system also enables it to transform some of the work into electrical current which can be stored or used as it is generated. For example, an elastic member may include a coaxial device that enables generation of electric current as the elastic element is stretched and or released. A variety of small power harvesting mechanisms may be employed, examples comprise but are not limited to solenoids, coils, piezoelectrics, micro-electric generator systems, reciprocating members to drive alternators, and the like.

Since the collar yoke 104 can be subject to significant forces, including a collar yoke stiffener 131 can help better manage those forces. An eyestay and collar stiffener 133 can help manage forces transmitted through channel 116 and overlay rotation zone 122. As forces increase, there is a tendency for upper 108 to slump or buckle. The eyestay and collar stiffener 133 can support eyestay 109, collar yoke 104 and upper 108 of shoe 100 from slumping or bending under the force received from the collar yoke 104. The size and shape of the eyestay and collar stiffener 133 can vary in accordance with the amount of force anticipated. While some of the downward force in collar yoke 104 will be transmitted into the malleolus bulges, much of the force from collar yoke 104 is transmitted down and forward, into upper 108 in alignment with the long axis of eyestay 109. Eyestay 109 and eyestay and collar stiffener 133 may be designed to pass multiple eyelets 106 to help ensure that forces are distributed and do not localize in one vulnerable spot. Such stiffeners may be optimized to meet shoe application requirements. As an example, FIG. 7B shows a variation of eyestay and collar stiffener 140.

The inferior eyestay and collar stiffener 133 can be fastened by a number of means including adhesives, stitching, grommeting of eyelets 106, anchoring to sidewall cage materials, anchoring to the midsole 102, and other means known in the art.

An upper stiffener 135 can help manage forces transmitted through channel 116 and rotation zone 122. As forces increase, there is a tendency for upper 108 to slump or buckle. Upper stiffener 135 can support the eyestay and collar stiffener 134. It can also transmit forces directly to midsole 102, reducing the amount of force distributed on the foot. The size and shape of upper stiffener 135 can vary in accordance with the amount of force anticipated. Upper stiffener 135 is shown adjacent but not connected to eyestay and collar stiffener 134. These two components may be integrated as one singular piece of material or may reside adjacent to each other. Upper stiffener 135 can be further strengthened by integration with cage materials over the sidewall integration with tension-bearing stitching 138 which, for example, connect eyelets 106 to midsole 102.

Supplemental Stiffener Interface Area

Referring again to FIG. 6, eyestay and collar stiffener 133 has a radiused receiving area 134. Collar yoke stiffener 131 has a radiused protrusion 132 that sits proximal to the eyestay and collar stiffener's radiused receiving area 134. Protrusion 132 has a smaller radius than the receiving area 134. By fastening eyestay and collar stiffener 133 and collar yoke stiffener 131 to the exterior shoe surface or to elastomeric overlay 120, a rotating joint is created that facilitates rotation. Orienting the radius of the eyestay and collar stiffener's radiused receiving area 134 towards the rear, the radius acts as a cup device that anticipates the forward and downward forces that are transmitted from the collar yoke 104 and the collar yoke stiffener 131. The differential in radius allows for a small amount of fore and aft laxity to reflect glide of the talus on the ankle mortice with ankle flexion and extension.

Supplemental Stiffener Alternatives

The term "supplemental stiffener" is used to generically refer to a stiffener constructed from any number of materials or combination of materials that can be employed according to the needs of each application. The common use of plastic sheet in heel counters of athletic shoes makes plastic sheet one choice for this application. Supplemental stiffening may also be achieved by judicious choice of leathers and other upper materials in layers and or laminates in areas of support.

That said, a wide variety of other materials can also be used. For example, use of carbon fiber and fiberglass components may be applied in many higher performance athletic shoes. A benefit of carbon fiber is its ability to be contoured in three dimensions with singular or multiple curves, including complex saddle shapes, while maintaining light weight and strength. Very high performance applications may require carbon fiber to enable high spring rates and energy storage and return capabilities. Metals and alloys can be used in sheet format, castings or other forms for certain applications, and may be used in toe box protection and shank creation. The use of laminated or corrugated sheets can also improve the structural qualities of the stiffeners. Use of higher forces and higher strength supplemental stiffeners may require stronger joint construction at their pivot interface proximal to narrow channel 116. A variety of hinge types may be used for a high strength pivot interface, including ball joints, pin hinges where the pin is either made of a high strength material or a shoe lace or other means known in the art.

Additionally, the use of tension-bearing stitching 138 or fibers to manage tensile forces between the eyestay and sole or heel counter establishes excellent opportunity for improving upper rigidity. The use of suspension bridge-like geometries creates stability in sidewalls. Similar tensile patterns can be established circumferentially to further boost stiffness. The use of caging materials is also known in the industry as a means to improve sidewall stability.

Additionally, the sides of collar yoke 104 may be constructed with horizontally oriented corrugated or hollow elements that resist bending near the Achilles, but enable flex and bending above the malleolus bulge. This further enables an oval shape of collar yoke 104 to apply force to the sides of the lower leg 118 without overly constricting the back of the lower leg.

Adhesive Application

FIG. 5 focuses on adhesive application and bonding to the substrate. The use of adhesives is well known for fastening in the footwear industry. Bonding of elastomeric overlay 120 to the surface below can be optimized. By eliminating the use of adhesives in close proximity to either end of elastic zone 121 or small areas within rotation zone 122, one can reduce the likelihood of overly high pressure points and extend the working range of motion and longevity of the elastomeric overlay 120. A diagram of zones that can be kept free of adhesives is shown in FIG. 5 and is labeled by grey zones 128.

Spring Rate Versus Cross Sectional Area

Assuming a consistent material selection and preparation across elastic zone 121 (FIG. 4) of elastorneric overlay 120 (FIG. 1), the spring rate of elastic zone 121 is correlated against the cross sectional area of the molded elastic member within the zone. Narrowing of the elastic zone 121 as viewed from the rear will reduce the cross-sectional area, assuming a constant thickness. This may be a problem in the event that a designer wishes to use an hourglass type of shape from the rear view. The starting spring rate of elastic zone 121 is predicated upon the narrowest cross sectional area. As such, it may be necessary to increase the thickness of elastic zone 121 to compensate for narrowing of elastic zone 121. Providing a longer volume with a consistent cross sectional area provides a more uniform spring rate and lower likelihood of undue fatigue in a small volume that could shorten the life of a product.

Lacing 105

As currently taught, the user tightens laces 105 of shoe 100 in the same way as is done with other high top athletic shoes. Laces 105 are oriented as shown in lace routing 136 such that they travel from eyestay 109 below anterior gusset 114 back to a loop in proximity to narrow channel 116 prior to moving up to eyelets 106 in collar yoke 104. In this way, rotation of collar yoke 104 will not place unnecessary forces that may loosen or tighten laces 105 during use.

A user of shoe 100 has an option to point their toes while tightening their shoelaces 105 to reduce tension in the elastic zone 121, but this is not a requirement. The user ties shoe 100 to the desired collar tightness, just as one would do with a conventional high top shoe. When shoe 100 is adequately tightened, shoe 100 may operate its force management features (for example, FIG. 8). When shoe 100 is worn slack and untied, the force management features are inactive. The user has an option to somewhat reduce the amount of engagement of the force management feature by intentionally keeping the collar yoke 104 loosely tied, thereby limiting the amount of range of motion that can be engaged. An elongated geometry of collar yoke 104, as mentioned earlier, restricts the amount of collar force applied to the rear face of lower leg 118, even when the user tightens the collar yoke 104 fully.

User Adjustment of Spring Rate

Some users of shoe 100 may wish to have ability to adjust the spring rate of their shoes in excess of the spring rate of elastic zone 121 of overlay 120. There are several ways that can be implemented, including the following:

1—Providing at least one supplemental elastic member that is integrated to the back of the heel counter region. The elastic member may be anchored near the interface to midsole 102 and have a neutral length short of the heel counter height. When not in use, the elastic member may reside external to shoe 100 or in a pocketed area. The user then has an option of pulling the top end of the elastic member and engaging it into a fastening device above posterior gusset 115. For example a small gage elastic cord may be utilized as the elastic member. It may be anchored at midsole 102 on its bottom end, and its top end may have a small hook affixed. When not in use, the small hook is visible above the heel counter, and when in use, the small hook could engage with a receptacle above posterior gusset 115, thereby increasing the spring rate.

The user could then adjust the supplemental elastic member(s) to match their desired level of force management for the activity in which they plan to engage. Any variety of anchoring systems can be employed. Shoe 100 may be constructed with a pull tab above the heel counter that extends back behind the limits of shoe 100. Having the supplemental elastic member and anchoring devices visible at the back of shoe 100 would have a similar aesthetic impact as a rear pull tab.

2—Coaxial elastic materials through the elastic zone. Similar to variation 1 in the paragraph above, the supplemental elastic member may be anchored along the sides of the collar yoke 104. By creating at least one hollow opening through elastic zone 121, an additional pair of elastic members can be oriented through elastic zone 121. Supplemental elastic members can be anchored at the base of the heel counter away from contact with the skin. They can then traverse past the heel counter and up through a hollow core of the elastic zone 121. They can then branch to the left and right sides of collar yoke 104 where they can be made tight or loose by the user. Adjustable anchoring can be accomplished by a variety of means, including lacing and ties, straps with hook and loop fasteners, etc.

3—Altering the active spring geometry. Elastic zone 121 can be altered by restricting its motion through a supplemental device. If elastic zone 121 has a slice down its midline as viewed from the rear, a physical element may be inserted that displaces the sides of the split elastic member outward, thus consuming some of the spring length and providing engagement of the elastic member at an earlier point of ankle rotation.

4—Supplemental elastic sheet material. The exposed area of the posterior gusset may be covered by an elastic sheet material. Any number of materials could be selected, including elastic wovens, non worvens, elastomeric sheet materials, etc. The shoe could be supplied with a variety of posterior gusset covers, each with a different spring rate to supplement the spring rate of the elastic zone 121. Posterior gusset covers would need to be anchored above and below the gusset in order to transfer and manage forces.

Thus, through a footwear system of the first embodiment, elastic mechanisms may be integrated into footwear which may assist user locomotion selectably by the user's either lacing the collar yoke 104 more tightly or loosely. Under flexion or dorsiflexion, pressure is applied from lower leg 118 into tongue 107 and from tongue 107 into laces 105. Laces 105 transfer forces into eyelets 106, and eyelets 106 transfer forces into a combination of the collar yoke 104, optional collar yoke stiffener 131, and overlay 120 (in the collar yoke adhesion zone 123). These components collectively manage torsional forces with narrow channel 116 and rotation zone 122 providing a fulcrum (through the superior rotation anchor zone 124) and then apply force into elastic zone 121 (through the superior elastic anchor zone) during use. Elastic zone 121 applies force into (through the inferior elastic anchor zone 127) the heel counter panel of the shoe 110. This force is then translated from the heel counter panel 110 area of the shoe into the foot.

As the user increases flexion and dorsiflexion, elastic zone 121 absorbs force and stores it as potential energy. This externalization of force reduces the amount of force that needs to be managed by the Achilles tendon, calf muscles and various other muscles & tendons and so elastic zone 121 assists a user's Achilles tendon. This reduction in force conserves energy of the user and can reduce fatigue.

As the user continues in their stride and starts to extend and plantar flex, the potential energy in elastic zone 121 is released and forces are exerted into the leg 118 and foot. This results in a locomotion system inducing the foot to extend and plantar flex, providing a harmonized return of energy at the same time the body requires energy to propel their gait. This application of force over time and distance results in work produced by the footwear force/energy management system. The work produced by the system can benefit the user by supplementing the output of work by the users' tendons and muscles thereby improving performance and enabling faster locomotion or higher jumping; or the work produced by the system can displace work required by the user's tendons and muscles thereby reducing the consumption of oxygen by the muscles and reducing the tendency toward fatigue.

Spring Location

Location of a tension spring within this embodiment is within the elastic zone 121 of the overlay 120. Spring force may be designed into additional areas in other variations of this first embodiment. For example, the attachment of eyelets 106 to collar yoke 104 may include an elastic component.

Application to Boots

The above description may be applied, for example, in design of high-top style athletic shoes. The same approach may also be employed within other footwear—such as hiking boots, work boots, military boots, cleated football shoes, and so on which may be modified to incorporate the structural elements and force and energy management systems of the first embodiment. A wide variety of sports may benefit from integration of such a system into their specific footwear, basketball players benefit from higher jumping and improved endurance & speed, volleyball players benefit from higher jumping and further distance in leaping reaches, baseball players benefit from higher top sprinting speeds, football players benefit from offsetting some loading on their Achilles during blocking, soccer and rugby players benefit from improved stamina and speed, runners and joggers benefit from reduced load on Achilles and improved endurance and speed over flat and hilly terrain, walkers benefit from improved endurance and easier hill climbing, hikers benefit from improved heel lock-down and lower likelihood of heel blistering while also enjoying improved endurance and the dynamic offset of pack weight, general footwear wearers enjoy the benefits of new and exciting aesthetic differentiation and styling made possible by the system.

Embodiment 2

Table of Reference Numerals

Second embodiment of a shoe 200
outsole 201
elastic member 202
interface between elastic member and outsole 203
rotatable collar yoke 204
rotation zone 205
interface between elastic member and collar yoke 206
alternative routing of elastic member 207
shaped elastic member 208
heel counter 209
posterior gusset 210
upper 211
liner 212
eyelet 213

FIG. 9 shows various side (FIGS. 9A, 9C and 9D) and a rear view (FIG. 9B) of another preferred embodiment of a shoe 200 incorporating many of the structural elements of first embodiment shoe 100. Shoe 200 functions similarly to the initial embodiment, but highlights different ways in which to create and anchor an elastic zone as well as different ways to create a rotation zone. This embodiment creates elastic tension through the use of an elastic member in lieu of an elastic zone within an elastomeric overlay as shown in the first embodiment (FIGS. 1-8).

FIG. 9 shows three different approaches to the creation of an elastic member. FIG. 9A shows an external side view of the embodiment and FIG. 9B shows an external rear view of the embodiment. FIG. 9C shows a cutaway view of the same embodiment to reveal construction layers, with a different approach to the shape and anchoring of the elastic member. FIG. 9D shows a different approach to the shaping, placement and anchoring of the elastic member.

An elastic member 202 running parallel to an Achilles tendon during use provides the force carrying capability between a collar yoke 204 and the heel area of shoe 200. In this configuration, the elastic member 202 is anchored at its base by becoming integral with shoe outsole 201 at an interface point 203. Modern athletic shoe construction often relies upon a variety of materials and colors in the construction of an outsole 201. Interface point 203 enables a continuous mold to service the outsole 201 and elastic member 202.

The elastic member 202 may have different material and performance properties than the material in outsole 201, allowing the elastic member to have higher qualities of elasticity with reduced elastomeric loss, while outsole 201 may have higher scuff resistance and wear properties.

Elastic member 202 is anchored at its top by splitting into a "Y" shape and fastening to both sides of collar yoke 204. Collar yoke 204 may include a supplemental stiffener element or it may rely upon a single or multiple layer construction of upper material to enable it to properly manage forces between the leg, rotation zone 205 (FIG. 9A) and elastic member 202. If a supplemental stiffener element is used, elastic member 202 may be anchored directly into the supplemental stiffener element. Elastic member 202 may also be anchored at the top by an adjustable feature, such as a link to a hook and loop strap system (not shown) that provided a fastener with adjustable length, or a series of hooks which can provide variable spring lengths.

Figure 9C:
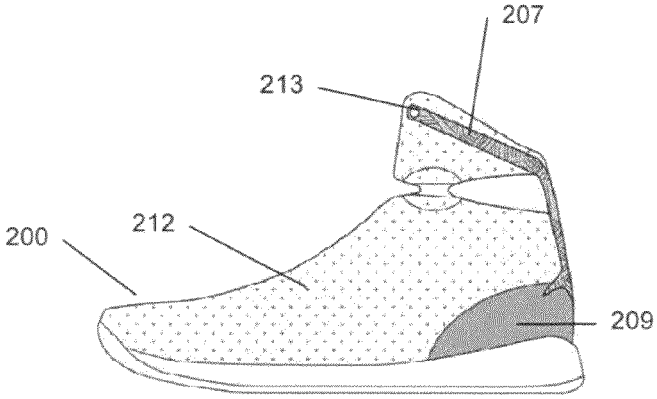
FIG. 9 shows another embodiment of footwear, the embodiment having a rotatable collar yoke.

FIG. 9C shows another approach to an elastic member 207. In this instance, the elastic member 207 is anchored at its top at one of the eyelets 213, for example, a top-most eyelet of collar yoke 204. The elastic member is supported through collar yoke 204. Elastic member 207 is anchored at its base, for example, by attaching to an internal heel counter 212.

Figure 9D:
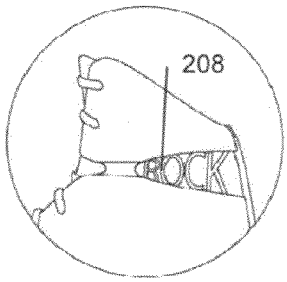
Figure 9A:
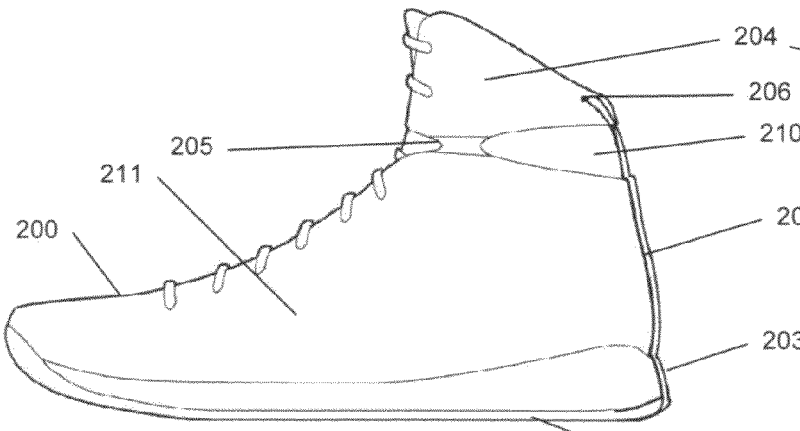
Figure 9B:
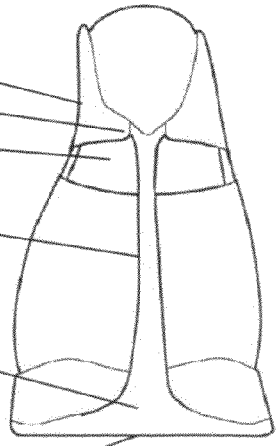

FIG. 9D shows another approach to an elastic member 208. In this instance, elastic member 208 is formed in a visually appealing shape. For example, elastic member 208 may be formed with shaped elastomeric material to create the letters R-O-C-K. This is one example of a visually appealing shape, and many other shapes may be employed. This is one example of the use of elastomeric material. Other spring materials may be employed—such as woven and nonwoven fabrics, sheet rubber, silicones, or other materials known in the art. Sheet materials such as latex may be employed where an appealing graphic is printed on the latex and the graphic changes its appearance upon stretch of the latex sheet during the opening of posterior gusset 210.

The various approaches in the design of the elastic members 202, 207 and 208, the superior anchor points and inferior anchor points may be arranged in a variety of combinations and still be novel. These approaches may also be employed with elements of the elastomeric overlay as shown in the prior embodiment to create novel aesthetic and functional solutions.

Each of the designs in FIGS. 9A, 9B, 9C and 9D utilize a rotation zone 205. In this embodiment, rotation zone 205 may be created from a flexible material that is bonded to the upper material above and below rotation zone 205. Flexible materials may include woven and non-woven fabrics, vinyls, rubbers, urethanes, silicones, and such materials known in the art. The materials may be single layered or a composite of multiple materials in multiple layers.

Any need for supplemental reinforcement of the areas above and below rotation zone 205 will depend upon the nature of the materials selected for upper 211 as well as the desired spring force of elastic member 202. If upper materials do not have sufficient rigidity to accommodate the spring forces during use, supplemental reinforcement may be introduced as described in the first embodiment.

Embodiment 3

Diagonal Tension Spring to Sliding Yoke

Table of Reference Numerals third embodiment of a shoe 300
heel counter panel 301
tension spring 302
collar 303
top collar yoke lobe 304
eyelets 305
D-ring 306
curved D ring 307
pivot point 308
anchor stitching 310
leg 311
passageway 312
inlet to passageway 313
tongue 315
laces 316
sliding surface 317
semi-rigid member 318
upper 319
foot 320

Figures 10A, 10B, 10C, 10D, 10E:
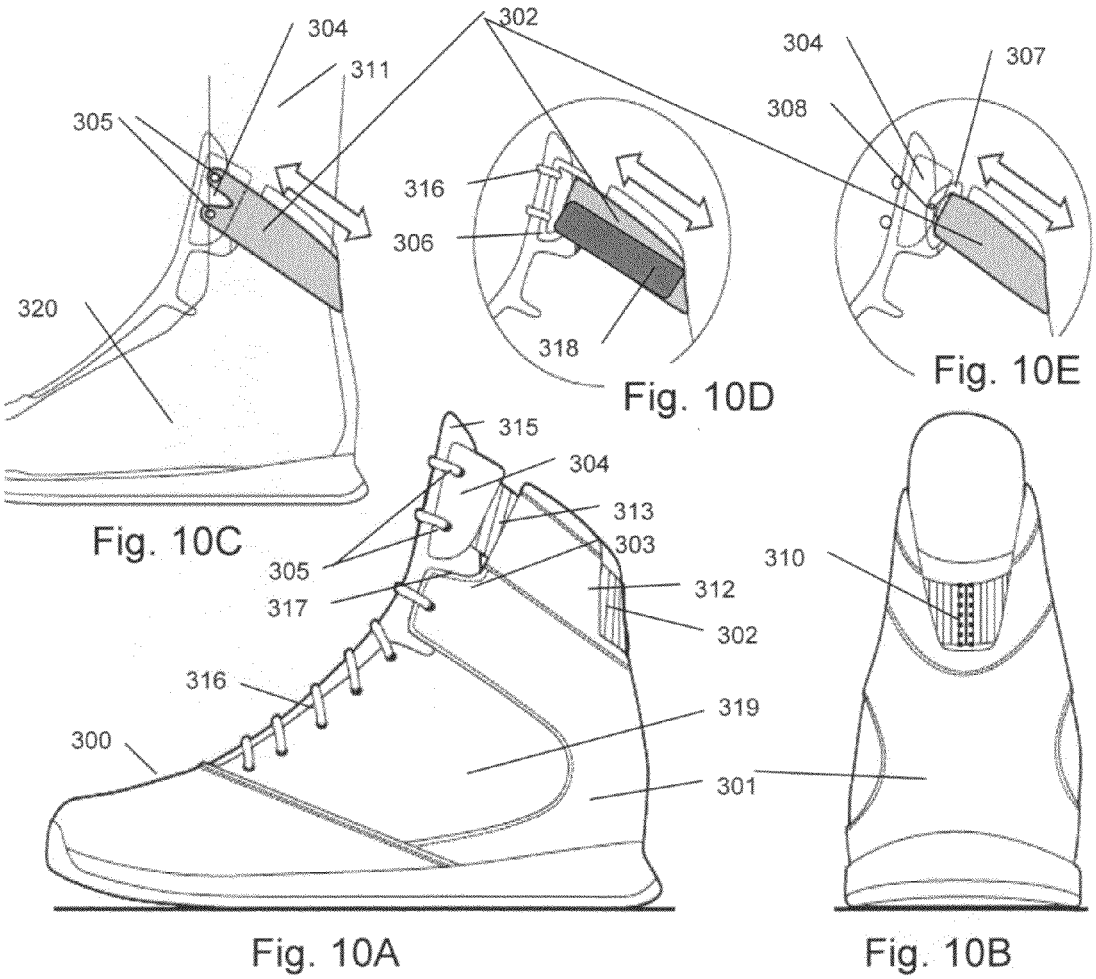
FIG. 10 shows another embodiment of footwear, the embodiment having a collar yoke tab and diagonal spring.

FIG. 10 shows several views of a third embodiment of a shoe which practices a force/energy management system similarly to the first embodiment, shoe 300. FIGS. 10A and 10B show external side and rear views, respectively. FIG. 10C shows an internal view of shoe 300, while FIGS. 10D and 10E show additional variations of the third embodiment.

FIG. 10 includes drawings of a modified high top athletic shoe 300, with a diagonal tension spring 302 at the top of shoe 300. Tension spring 302 may have an inferior anchor above a heel counter 310 and a superior anchor at a high top collar yoke lobe 304. The shoe 300 includes an upper 319 and a collar assembly 303 that is the above the upper 319.

Upper Anchor Variations

Without specific drawing references, force from a leg 311 is transferred into a tongue, into laces, into eyelets, into a yoke, into a tension spring, into the rear of the shoe above the heel counter during locomotion.

Tension spring 302 may be anchored to the high top collar yoke lobe 304 through a variety of means. FIG. 10C shows the top collar yoke lobe 304 as a multiple ply construction of vinyl, fabric, leather or other material common in shoe making. In this embodiment, tension spring 302 is sandwiched between the plies of the material used to construct the top collar yoke lobe 304 and anchored by connection to eyelets 305.

FIG. 10D shows tension spring 302 coupled to an off-set D-Ring 306. Laces, 316 are also connected through the off-set D-Ring 306. D-Ring 306 acts in lieu of the top collar yoke lobe 304.

FIG. 10E shows tension spring 302 attached to a curved D-Ring 307 which can be attached to a top collar yoke lobe 304. Curved D-Ring 307 is fastened rotatably through a pivot point 308 to the top collar yoke lobe 304. The pivot point 308 allows the top collar yoke lobe 304 to rotate relative to the spring and allow laces 316 to lay flat against the user's leg 311.

In each of the configurations of FIG. 10, force is applied to and from the lower front face of leg 311, into a tongue 315, into laces 316, into eyelets 305, into the top collar yoke lobe 304 or D-Ring 306, into tension spring 302, into the rear of shoe 300 above the heel counter during locomotion.

Flexibility in shoe 300 to allow forward rotation of the leg 311 is enabled by separation of the of the top collar yoke lobe 304 away from the rest of the collar 303. This allows range of motion of the lobe to follow the leg 311 as it moves forward in flexion towards dorsiflexion and back in extension towards plantar flexion. The tension spring 302 has primary force direction in linear tension, but also can resist shear and rotation.

Tension spring 302 is anchored, for example, to the top of the heel counter panel 301 through stitching 310, adhesive or other common means in proximity to the top of the heel counter 301. In this manner, force from the tension spring 302 is transferred into the shoe 300 during locomotion. Shoe 300 thereby may transfer force into a users' foot 320.

Construction

Tension spring 302 passes through a passageway 312 created in the collar 303. The passageway 312 for spring 302 is created to allow tension spring 302 to stretch linearly (direction arrow) with minimal resistance, but provides support to assist tension spring 302 from being pulled or slumping in the downward direction during motion of leg 311. This resistance in the downward direction helps prevent high top collar yoke lobe 304 from excessively slumping down the user's leg 311 in dorsiflexion or plantar flexion. The force/energy management system of shoe 300 can be further supported against slump by use of a semi-rigid member 318 that can add supplemental rigidity to tension spring 302 while inside passageway 312 and act as a cantilever to prevent downward slump of top collar yoke lobe 304. Semi-rigid member 318 can be fastened to tension spring 302 or attached to high top collar yoke lobe 304.

Lacing Detail

When the laces 316 are loose, the top collar yoke lobe 304 is pulled by tension in tension spring 302 to a resting spot against the vertical front face of the collar 303. The shoe 300 therefore can maintain the appearance of current high top athletic shoe designs. To tighten the shoe 300, the user may position his or her foot in the plantar flexed position (tip toe) and tighten the shoe as one would any other high top shoe. Upon returning to an upright stance, the tension spring 302 stretches to reflect the increase in distance between top collar yoke lobe 304 and top of the heel counter 310.

Locomotion of Shoe 300

In the gait cycle, the length of tension spring 302 expands during flexion/dorsiflexion and contracts during extension/plantar flexion. In this manner, tension spring 302 is able to contribute to energy management, for example, in a similar manner as the embodiments described above. Dorsiflexion in the ankle leads to forward motion of leg 311 relative to the back of the foot 320, which applies force on tongue 315, which applies force on laces 316, which apply force on top collar yoke lobe 304, which applies a diagonal force (directional arrow) on tension spring 302 which manages the energy and applies force on the inferior anchor 310 above the heal counter panel 301, which is part of shoe 300, which imparts upward force on the heel of foot 320. The end result is that the forces extend the foot toward plantar flexion.

Tension spring 302 exerts force against dorsiflexion thereby saving muscle exertion in the early phase of the gait cycle. The result of applying force over distance is that the work results in elastic potential energy being stored in tension spring 302. Later in the gait cycle as the ankle starts to extend toward plantar flexion, tension spring 302 then exerts force to support plantar flexion thereby saving muscle exertion in that phase of the gait cycle.

Figure 13:
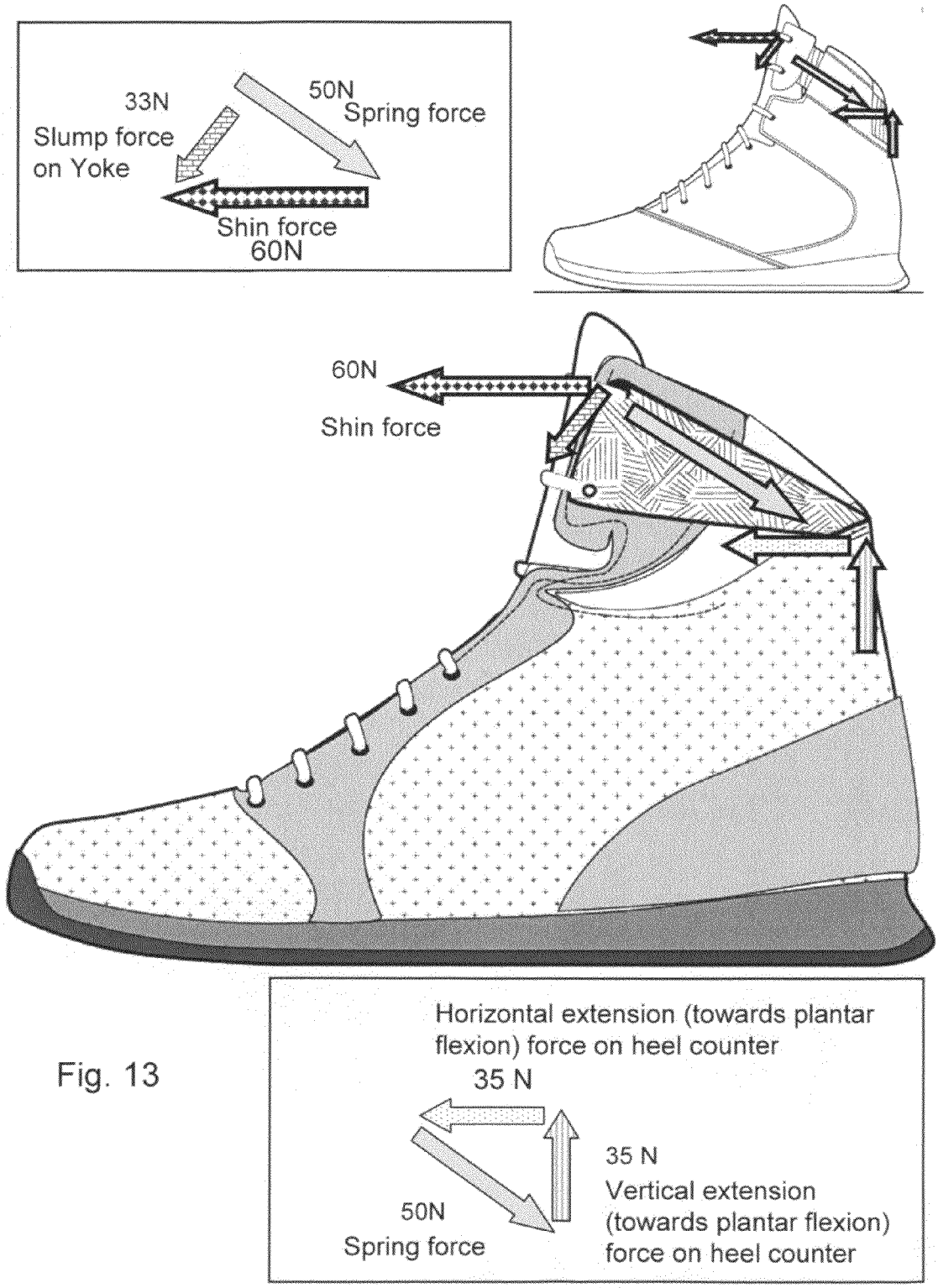
FIG. 13 shows a hypothetical diagram of forces applied to one side of an embodiment according to FIG. 10 or 11.

Depending upon the activity, such a force/energy management system can create a range of motion of 2.5 cm or more across primary tension spring 401. Referring now to FIG. 13, primary forces associated with diagonal tension spring embodiments are described. Embodiment shoe 300 and embodiment shoe 400 are both shown for clarity, and represent similar force arrangements. Other forces associated with gait and athletic usage are acknowledged but not shown to help ensure clarity of the drawing. Five forces are shown, spring force, shin force, slump force, horizontal extension force, and vertical extension force. Spring force is associated with a tension spring, for example, spring 302. Shin force is associated with the front face of the lower leg and passes through a tongue, for example, tongue 315 prior to being transferred to other components. Slump force is associated with a tendency for the top collar yoke lobe 304, for example, lobe 304 to slide down the front face of the leg. Horizontal extension force is associated with an area above the top of the heel counter panel 301 and drives shoe 300, 400 forward relative to the foot. Vertical extension force is associated with an area above the top of the heel counter panel 301 and lifts shoe 300, 400 up relative to the foot. The horizontal and vertical extension forces work to keep shoe 300, 400 in close contact with the foot, and also help drive plantar flexion motion. Assuming that the lateral and medial tension springs 302 have a collective spring rate of 20 Newton/cm, an increase in length of 2.5 cm could provide 50 Newton of force at full extension. As this force is anchored near the top of the heel counter panel 301, the force creates the equivalent of approximately 35 Newton in the lifting direction and 35 Newton in the forward direction. This diagonal direction of the linear force upon the top of the heel counter panel 301 area aids in lifting the heel of the shoe 300 toward the heel of the user, improving comfort and security of the shoe 300 against the foot while also driving plantar flexion motion.

Range of motion of top collar yoke lobe 304 is dependent upon maintaining position on the lower leg 311 and prevention of slumping down the leg. Provision of a surface for allowing top collar yoke lobe 304 to slide fore and aft in alignment with tension spring 302 without slumping down can be accomplished in many ways. For example, use of a sliding surface 317 (FIG. 10A). This sliding surface 317 allows fore and aft motion of top collar yoke lobe 304 while resisting downward motion by top collar yoke lobe 304.

User Adjustment of Spring Tension

This third embodiment could be modified to also include adjustment features that enable a user to adjust the spring rate and laxity in shoe 300. For example, tension spring 302 shown in FIG. 10 can be passed through a length adjustment feature as may be known from the art of fabric webbing and straps found on backpacks and such. Tension spring 302 could also be adjusted by passing through a D-Ring 306 as shown in FIGS. 10D and 10E and then anchoring with a hook and loop anchor system as is common in footwear design. This would enable a user to adjust the initial spring laxity or tightness, thereby adjusting spring rate and complexion to meet their immediate needs.

Embodiment 4

Diagonal Tension Spring to Hinged Yoke with Fore/Aft Laxity

Table of Reference Numerals

Fourth shoe embodiment 400
primary tension spring 401
supplemental tension spring 402
inferior anchor 403
heel counter 404
heel counter panel 405
collar of the shoe 406
eyelet 407
anterior gusset 408
posterior gusset 409
top collar yoke lobe 410
narrow channel of material 412
laces 414
flexible sock liner 415
tongue 416
stitching 417
eyestay 418
upper 420

FIG. 11 shows a fourth shoe embodiment having a force/energy management system similar to that of the first embodiment which will be further discussed with reference to FIG. 13, a shoe 400 having a diagonal tension spring system 401, 402. FIG. 11A shows an external side view while FIG. 11B shows a rear view of the same embodiment. FIG. 11C shows a side view of a partial cutaway of the same embodiment while 11D shows the rear view of the same shoe 400.

Figure 11A:
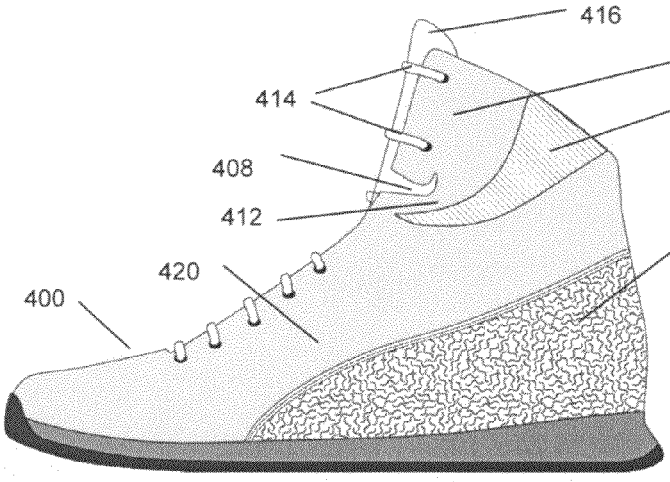
FIG. 11 shows another embodiment of footwear, the embodiment having a collar yoke and a combination of springs.
Figure 11B:
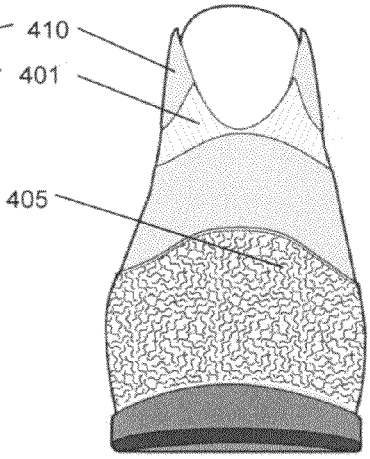
Figure 11C:
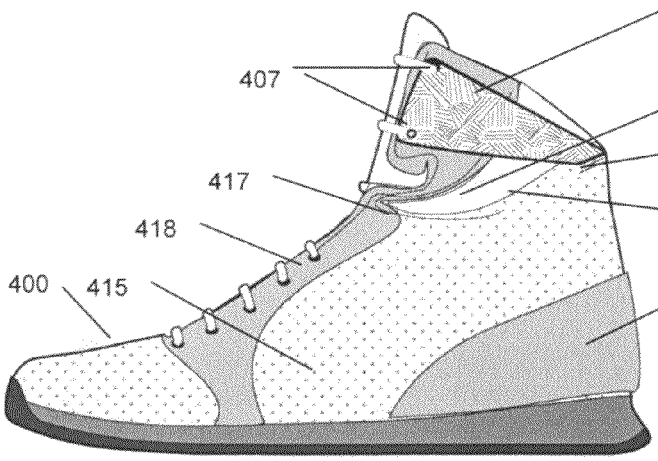
Figure 11D:
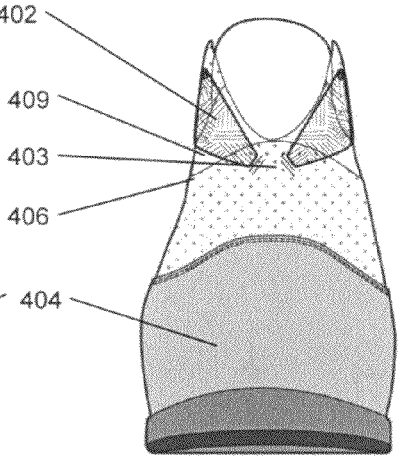

FIGS. 11A, 11B, 11C and 11D are drawings, for example, of a modified high top athletic shoe 400, with a shaped anterior gusset 408 and a posterior gusset 409 which divide the upper 420 such that a narrow channel of material 412 remains thereby creating a top collar yoke lobe 410 section of upper 420. Top collar yoke lobe 410 is capable of motion during use and is also connected to a collar 406 by at least one tension spring 401, 402 oriented diagonally. A diagonal tension spring system may include at least one of a primary tension spring 401 (FIGS. 11A and 11B) and supplemental tension spring 402 (FIGS. 11C and 11D). So spring 401 overlays spring 402. The primary tension spring 401 is made out of sheet material and has an inferior anchor along a collar of the shoe 406 and a superior anchor along the boundary surface of the high top collar yoke lobe 410 with the posterior gusset 409. The secondary tension spring 402 has an inferior anchor 403 above the top of a heel counter 404 and a superior anchor at a high top collar yoke lobe 410 by connection to eyelets 407. Inferior anchors can be fastened through any common means. Anchors may affix to internal layers such as flexible liner material 415, layered materials used in construction or outer surfaces such as upper 420.

Flexibility in the shoe 400 to allow forward rotation of the leg is enabled by distinction of the of the top collar yoke lobe 410 as a movable entity relative to the rest of the collar 406 by means of a shaped forward gusset 408 and a posterior gusset 409. The positioning of said gussets results in a narrow channel of material 412 that enables rotation in the top collar yoke lobe 410 as well as fore and aft laxity of motion. The tension springs 401 and 402 have primary force direction in linear tension and can manage forces between the top collar yoke lobe 410 and collar 406.

Lacing and Appearance

When the laces 414 are loose during use, top collar yoke lobe 410 is pulled by tension in tension springs 401 and 402 to a resting spot dictated by the pre-tensioning of springs 401, 402. Shoe 400 therefore does not suffer from negative aesthetic impact of appendages or ancillary equipment. Shoe 400 can thereby maintain appearance qualities similar to other high top athletic shoes and offer an opportunity for delivering appealing ornamental designs that engage and interest buyers.

To tighten shoe 400, the user may position his or her foot in the plantar flexed position (tip toe) and tighten shoe 400 as one would any other high top shoe. Upon returning to an upright stance, tension springs 401 and 402 stretch to reflect the increase in distance between top collar yoke lobe 410 and top of the inferior anchor 403 and collar 406.

Foam padding is commonly used in the construction of athletic shoes. It is assumed that a shoe designer would select an appropriate grade of foam padding to employ within the posterior gusset 409 space to maintain the appropriate comfort to the user. Padding would need to be able to compress and stretch across its planar dimensions to accommodate range of motion in the posterior gusset 409. This range of motion can be further accommodated by incisions across the foam surface to enable further stretch.

Function

In the gait cycle, the lengths of tension springs 401 and 402 expand during dorsiflexion motion and contract during plantar flexion motion. In this manner, tension springs 401 and 402 are able to contribute to force/energy management of shoe 400 during use. The tension springs 401 and 402 exert force against dorsiflexion thereby saving muscle exertion in the early phase of the gait cycle. The result of applying force over distance is that the work results in elastic potential energy being stored in tension springs 401 and 402. Later in the gait cycle as the ankle starts to extend towards plantar flexion, springs 401, 402 then exert force to support plantar flexion thereby saving muscle exertion in that phase of the gait cycle.

Dorsiflexion motion in the ankle leads to forward motion of the leg 411 relative to the ankle which applies force on the tongue 416, which applies force on the laces 414, which apply force on the top collar yoke lobe 410, which applies diagonal force on springs 401 and 402, which manage the energy and apply force on the inferior anchor 403 above the heel counter 404; thereby imparting an upward force on the heel of foot.

Depending upon the activity, such a force/energy management system can create a nominal range of motion of 2.5 cm or more across primary tension spring 401. Assuming that primary tension spring 401 has a spring rate of 20 Newtons/cm, an increase in length of 2.5 cm could provide 50 Newton of force at full extension. Assuming that the supplemental tension spring 402 has a spring rate of 10 Newtons/cm, an increase in length of 2.0 cm could provide an additional force of 20 Newton at full extension. The diagonal direction of the linear forces aids in lifting the heel of shoe 400 toward the heel of the user, improving comfort and security.

The resting length and spring rate of the two springs 401 and 402 can be tuned to provide non-tension spring rates that are advantageous to athletic activity. For example, the supplemental tension spring 402 could have a spring rate of 30

Newtons/cm, but have 1 cm of laxity prior to engagement. This would yield no increased spring force until more than 1 cm of bottom spring extension. At full extension of 2.0 cm, the spring would then provide an additional 30 N of force.

Reinforcement

Range of motion of the top collar yoke lobe 410 is dependent upon maintaining position on the lower leg and prevention of slumping down the leg. Stitching 417 is shown as one means of increasing the rigidity of an internal or external eyestay 418. Eyestay 418 is shown traversing to the midsole as a means to help resist downward motion along the top of the foot surface or slumping. In this fourth embodiment, stitching 417 can improve the resilience and viability of the shoe's construction material—such as vinyl, fabric, leather, and the like. The stitching 417 can also be crossed, as shown, in an "X" shaped pattern in the area of narrow channel 412. The "X" shaped pattern allows for rotation across narrow channel 412 while minimizing deformation and wear from shear, tension or compression. Eyestay 418 may also be made more rigid by the addition of supplemental materials or stiffeners.

Anterior Gusset Shape

The anterior gusset 408 has an upward facing component at an end pointing toward top collar yoke lobe 410. The boundaries of the anterior gusset 408 are created by the convergence of an outer radius emanating from a continuation of the gusset's lower edge which meets an inner radius emanating from a continuation of the gusset's upper edge. Such an upward facing removal of material is designed to facilitate a small amount of forward laxity of the top collar yoke lobe 410. While a straight-walled anterior gusset 408 with no upturn may enable rotation across narrow channel 412, such an anterior gusset may resist fore and aft motion of top collar yoke lobe 410. Shaping of anterior gusset 408 with an upward facing component provides laxity to enable a small amount of fore and aft motion of top collar yoke lobe 410 to follow the fore and aft range of motion of the leg associated with slide laxity in the ankle joint while minimizing resistance and extending the longevity of the narrow channel 412.

Embodiment 5

Diagonal Tension and Stay System

Table of Reference Numerals

Fifth shoe embodiment 500
bi-directional springs 502
inferior anchors along the bottom collar 504
superior anchors along the top collar 505
rotatable stays 506
bottom collar 509
top collar yoke 510
leg 511
bootie 512
strap closure 515
floating bootie 514

FIG. 12 shows a fifth shoe embodiment, shoe 500. FIG. 12A shows an external side view while FIG. 12B shows a rear view of shoe 500. FIG. 12C shows a partial cutaway view of shoe 500 as does FIG. 12D which also includes a view of a user's leg 511 and the user's foot in a tight fitting bootie 512 of shoe 500.

FIGS. 12A, 12B, 12C and 12D are drawings of a modified high top athletic shoe 500, with bi-directional springs 502. One example of bi-directional springs is elastomeric sheet which offers spring force in both horizontal and vertical planes. Springs 502 have an inferior anchor along the bottom collar 504 and a superior anchor along the top collar 505.

Flexibility in shoe 500 to allow forward rotation of the leg 511 is enabled by separation of the top collar yoke 510 away from bottom collar 509 by means of rotatable stays 506. By rotatable stays is intended the ability to assist rotation of the leg 511 during locomotion. Rotatable stays 506 have inferior anchors along the bottom collar 504 and superior anchors along the top collar 505. Rotatable stays 506 may be fastened to their anchor points in a variety of ways, such as stitching or through resting in a sewn pocket, or other means. Rotatable stays 506 may be integral with the springs 502 or may be positioned adjacent.

In the gait cycle, the position of top collar yoke 510 relative to bottom collar 509 moves forward in dorsiflexion and rearward in plantar flexion. Biasing the geometric resting angle of the rotatable stays 506, one can create a vertical motion relative to the horizontal motion. By rotatable, it is intended that each rotatable stay 506 creates a three bar linkage, where the top collar yoke 510 represents one bar, the rotatable stays 506 represent one bar and the bottom collar 509 represent one bar. During the gait cycle, the top collar yoke 510 moves fore and aft relative to the bottom collar 509. This fore and aft motion results in a change in rotation angle of the stay relative to the top collar yoke 510 and bottom collar 509. Using geometric principles, one can establish a starting angle and length of the rotatable stays 506 and thereby create a motion tangential to the fore aft motion which can either create more or less distance between the top collar yoke 510 and bottom collar 509.

Figure 12C:
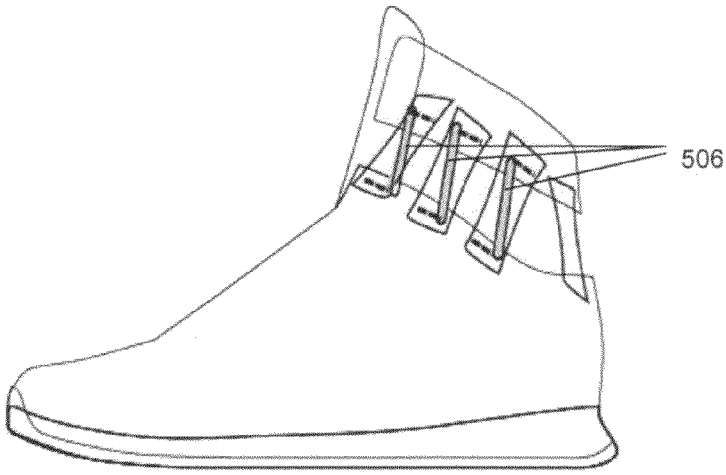
FIG. 12 shows yet another embodiment of footwear, the embodiment having a top collar and stay arrangement.
Figure 12B:
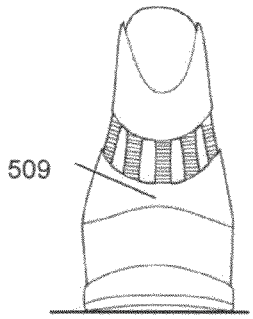

When rotatable stays 506 are oriented in a forward-canted angle at rest, as shown in FIG. 12C, forward motion of the top collar yoke 510 results in a reduction in gap between the top collar yoke 510 and bottom collar 509. This reduction in distance between collars pulls the heel of shoe 500 up relative to the top collar yoke 510 as it moves forward during dorsiflexion. By having the top collar yoke 510 place downward force on the front of leg 511 as well as the sides of the lower leg 511 through the malleolus ankle bulge, the force/energy management system of shoe 500 can place an equal and opposite lifting force on the bottom rear of the foot to drive the user towards plantar flexion.

Depending upon the activity, such a system can create a forward range of motion of 2 cm or more in top collar yoke 510 relative to bottom collar 509, and a vertical range of motion of 0.4 cm or more in the gap between top collar yoke 510 relative to bottom collar 509.

The embodiment in FIG. 12 also may include an internal slipper-type of liner known in the industry as a bootie 512. Booties are alternative means of providing comfortable liners. In shoe 500, the heel area of bootie 512 may be connected to top collar yoke 510.

Figure 12D:
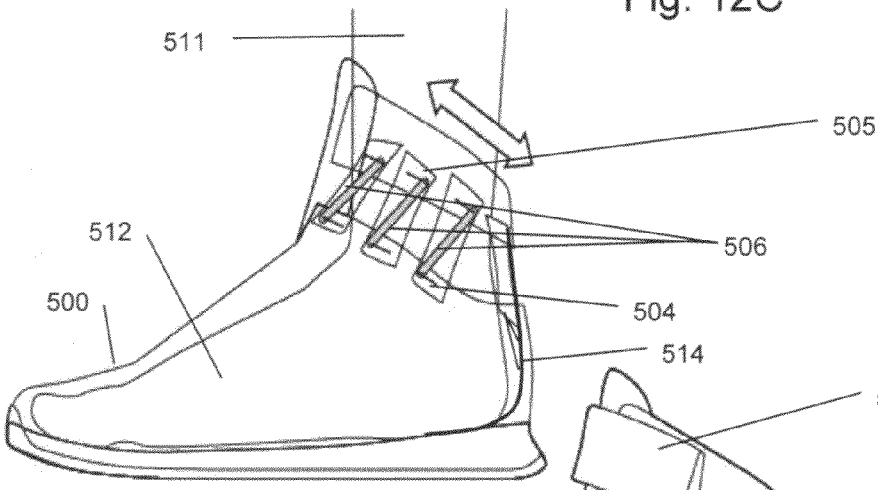
Figure 12A:
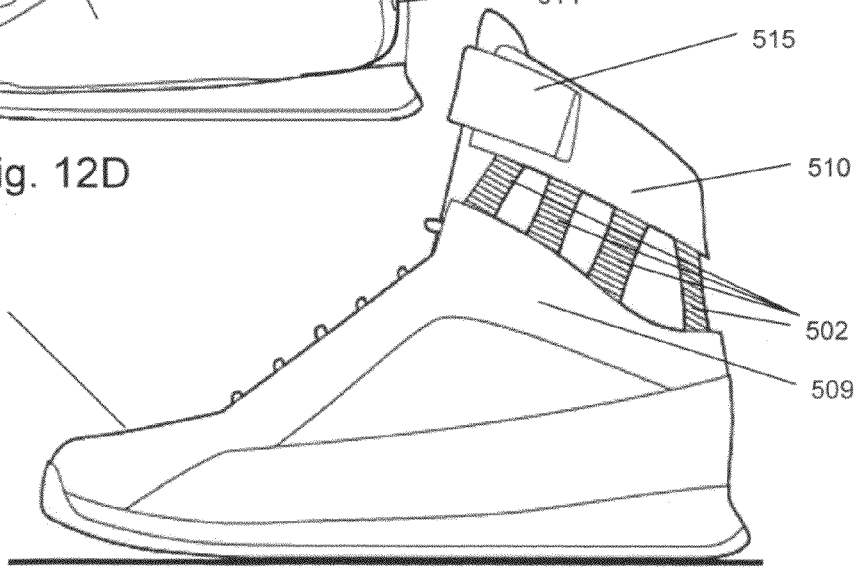

When stays 506 are oriented in a rearward canted angle at rest, as shown in FIG. 12D, forward motion of top collar yoke 510 results in an increase in gap between the top collar yoke 510 and bottom collar 509. This increase in distance between collars pulls the heel of bootie 512 up relative to shoe 500 during dorsiflexion. By having top collar yoke 510 place upward force on the foot through the bootie 512, the system can place an equal and opposite lifting force on the bottom rear of the foot to drive the user towards plantar flexion.

Depending upon the activity, such a system can create a forward range of motion of 2 cm or more in the top collar yoke 510 relative to the bottom collar 509, and a vertical range of motion of 0.3 cm or more in lifting the bootie 512.

Embodiment 6

Open Yoke Vertical Spring Sandal

Table of Reference Numerals

Sixth embodiment—shoe 600 in the fowl of a sandal
outsole 601
footbed 602
elastic member 603
inferior elastic anchor 604
superior elastic anchor 605
forward strap stanchion 606
aft strap stanchion 607
foot strap 608
front ankle strap 609
rear ankle strap 610
yoke side 611
yoke pivot 612
leg strap pivot 613
leg strap 614
aft strap stanchion stiffeners 615
yoke stiffeners 616

Figure 14:
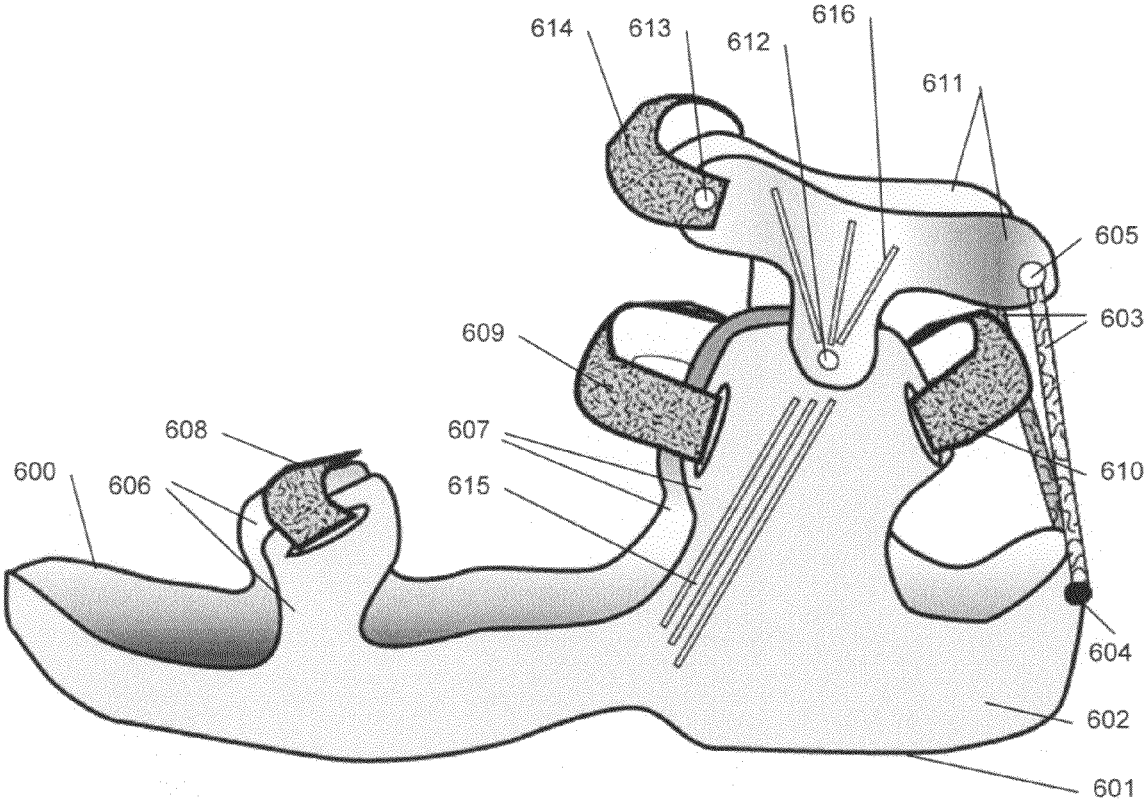
FIG. 14 shows another footwear embodiment in the form of a sandal with an open yoke.

FIG. 14 shows an external side view of sixth embodiment, sandal 600. FIG. 14 is a drawing of a modified sandal 600, with an open yoke system that transfers force from a leg over a pivot to a spring.

The foot is held to the sandal 600 by way of sandal straps, which include a foot strap 608, front ankle strap 609 and rear ankle strap 610. The foot strap 608 is anchored to the sandal 600 by a forward strap stanchion 606. Ankle straps 609, 610 are anchored to shoe 600 by an aft strap stanchion 607. The configuration of straps described here is only one of many configurations possible in sandal design. People with knowledge of the art may configure other strap systems for the traditional elements of the sandal in ways that fit their application.

Force is received from the lower leg into a leg strap 614. The leg strap 614 is an element of a yoke and is rotatably anchored to a yoke side 611 through a leg strap pivot 613. A purpose of leg strap pivot 613 is to enable sufficient rotation of leg strap 614 to enable leg strap 614 to lie flat against the user's lower leg, distributing pressure evenly and reducing possibilities of pressure points and chaffing.

Flexibility in the sandal 600 to allow forward rotation of the leg in dorsiflexion is enabled by allowing yoke sides 611 to rotate. Rotation is enabled by a yoke pivot 612 which rotatably connects each yoke side 611 to an aft strap stanchion 607.

A superior elastic anchor 605 connects a yoke side 611 to an elastic member 603. The elastic member 603 may be made of a variety of elastic materials, for example rubber, silicone, thermoplastics, urethanes, etc and may be in a variety of shapes, such as round cord, flat cord, sheet or other shapes depending on the design. Elastic member 603 may be of an off the shelf material such as a bungee cord, or it may be custom shaped (ie: molded) for the application. Elastic member 603 may include two or more separate elements (two shown) or may comprise a singular element that is divided at the top (for example, Y shape) to enable connection to the medial and lateral yoke sides 611 via the superior elastic anchors 605. Elastic member 603 may also be shaped, for example, through the use of a molded elastomeric component cast into a "Y" shape.

Aft Stanchion

The aft strap stanchion 607 of sandal 600 will be taller than in typical sandal applications. This additional height provides an ability to elevate yoke pivot 612 to a location that is closer to an axis of rotation of the ankle during use. To be clear, the elevation of a yoke pivot 612 on the medial side may be higher than a yoke pivot 612 on the lateral side to help keep the axis of yoke rotation similar to the axis of ankle rotation.

To help manage forces in the aft strap stanchion 607, further reinforcement may be necessary. The aft strap stanchion 607 may be reinforced in a variety of ways, by judicious choice of materials, layers and thicknesses or by addition of supplemental aft stanchion stiffeners 615. These stiffeners may be of same or different materials as the aft strap stanchion 607.

Function

Force from the front of the user's lower leg is transmitted into leg strap 614, which is transmitted into leg strap pivot 613, which is transmitted into yoke side 611 during locomotion. With the benefit of yoke pivot 612, the yoke 614, 611 rotates to transfer force into the superior elastic anchor 605, which is transmitted into elastic member 603, which is transmitted into inferior elastic anchor 604, which is transmitted into footbed 602 and thereby into the heel area of the foot. Components are described as independent elements herein, but may be constructed in various other ways known to a design in the sandal arts. For example the yoke sides 611 may incorporate a leg strap 614 and be one contiguous object which has sufficient flexibility in the strap area to obviate the need for a yoke pivot 612.

Fold-Away

As with the other rotating embodiments described herein, sandal 600 stores potential energy during dorsiflexion and returns it during plantar flexion. Yoke sides 611 and leg strap 614 may be rotated aft and worn behind or under the foot when support from elastic member 603 is not desired.

Spring Adjustment

As with other embodiments, spring 603 may be tuned to various applications and also adjusted by the user to suit the user's needs. Elastic member 603 may be anchored to the yoke side 611 by a variety of means, including hook and loop fasteners, buckles, adjustable straps and the like.

Application of the Embodiment in Various Environments

Sandals are used worldwide for a wide variety of applications. Sandals are often used in many lower income areas as a low cost footwear alternative. Many people, especially people of limited income, rely upon walking as their primary means of mobility. The ability of a sandal to offer improved gait performance can translate to an easier experience of walking, especially when one is relying upon walking as their primary means of mobility.

A person who weighs 600 N and who uses a sandal as disclosed herein with a 30N/cm spring rate may experience approximately 3 to 8% of ankle forces externalized out of their body and into the sandal during their gait. This assistance can facilitate mobility and dynamically offset the weight of a load carried by the user. For people who rely on walking for mobility, this can be a distinct advantage.

Application of an Open Yoke System in Other Footwear

This same type of open yoke force/energy management system may also be employed in closed shoes, such as running shoes or tennis shoes which are traditionally not sold as high tops. In the sandal embodiment, the yoke 614, 611 is supported by a yoke pivot 612 into an aft strap stanchion 607. In a closed shoe such as a tennis shoe or running shoe, yoke sides 611 could be attached via a pivot into a sidewall of the upper of the shoe. The shoe may need to have additional support within its sidewall to prevent slumping or buckling.

When used in such shoes, their sidewall and upper may be supported by additional caging, by tension-bearing stitching between the eyelets and the midsole, by the inclusion of stiffeners such as employed in heel counters, by adding additional layers of upper material, by extending the arch support or shank up the sidewall to behave as a stanchion, to incorporate a stanchion via a molded overlay on the outside of the upper, or related design methodology.

Embodiment 7

Tall Boots Having a Cantilevered Yoke

Table of Reference Numerals

Seventh shoe embodiment 700 in the form of a boot
outsole 701
heel counter panel 702
lower collar 703
elastic sheet 704
collar yoke cantilever 705
cantilever support 706
leg collar 707
upper eye stay 708
anterior gusset 709
eyelets 710
quarter panel 711
lower eye stay 712
toe box 713
elastomeric material 714
heel counter 715
yoke reinforcement 716
cantilever reinforcement 717
sock liner and padding system 718
upper eye stay reinforcement 719
lower eye stay reinforcement 720
structural toe protector 721

Figure 15A:
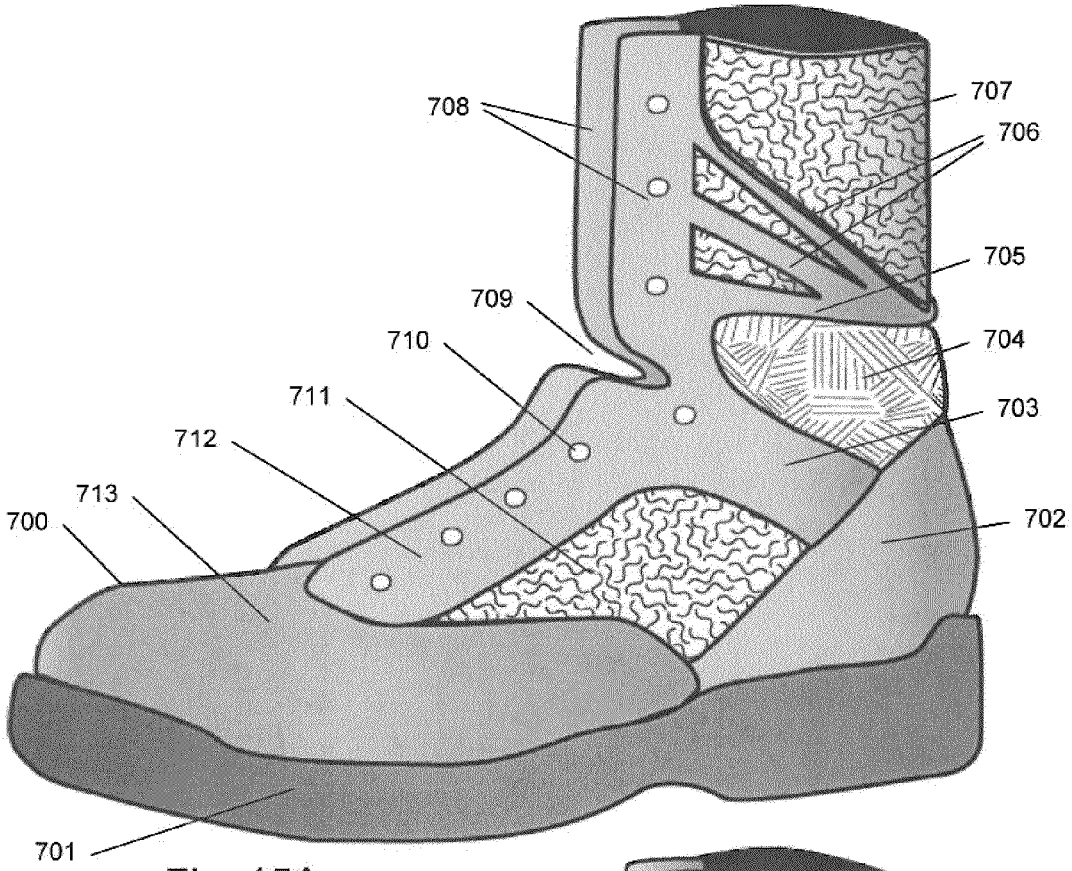
FIG. 15 shows another footwear embodiment in the form of a boot with a collar yoke cantilever.
Figure 15B:
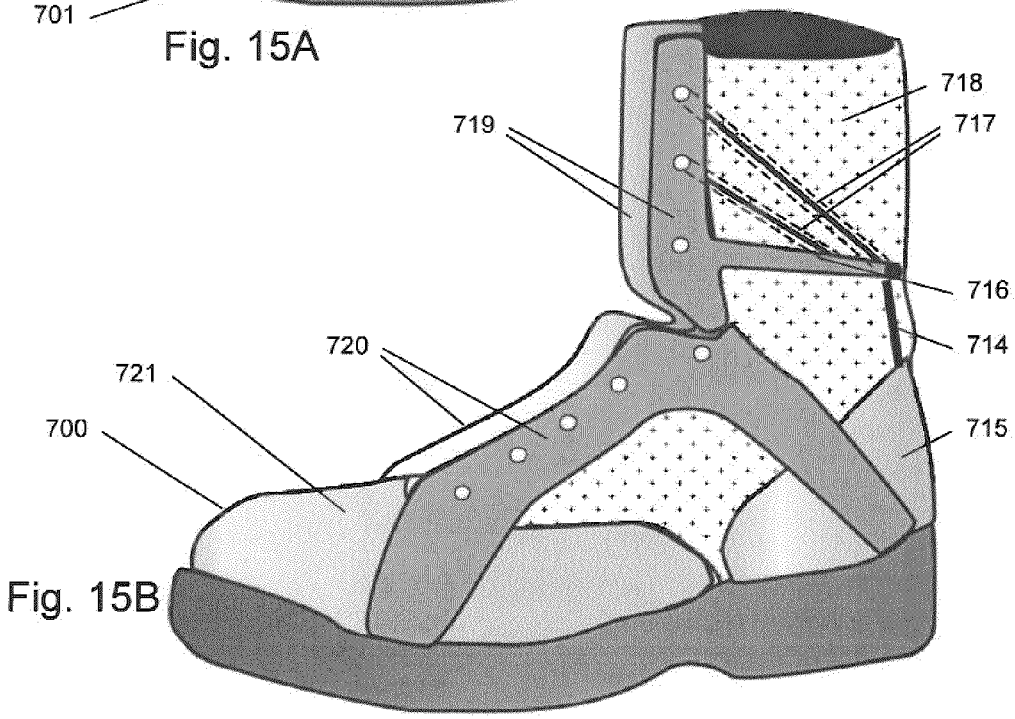

FIG. 15 shows side views of a seventh embodiment of a shoe, boot 700. FIG. 15 is a drawing, for example, of a modified military boot 700, with a collar yoke cantilever system that transfers force from a leg over a pivot to an elastic spring system. FIG. 15 A is an external side view of the embodiment, and FIG. 15B is a side view of the same embodiment with external layers removed to enable viewing of internal construction layers.

Boot 700 has been modified to enable a variety of elastic spring combinations to be deployed in a manner that is consistent with various design and aesthetic constraints. For example, military boot standards typically require adherence with a code for uniforms. These codes often limit the addition of any additional nontraditional appendages to the exterior surface of the boot. For example, the use of metal hooks, buckles or appendages may be limited, deviation from color specifications may be limited and so on. Boot 700 as depicted and described herein enables integration of force management approaches which may enable boot 700 to remain within the uniform codes.

Many boots have similar designs to high top athletic shoes, especially hiking boots and other configurations such as law enforcement boots and boots worn by safety personnel. This enables boot 700 to practice principles of design of earlier-described embodiments to incorporate a force/energy management system as described above.

A challenge with certain tall boots, including military boots constructed for warm weather or light weight boots, is that the portion of the collar which wraps the lower leg is often made of a low rigidity woven material, often as thin as a single ply canvas or duck fabric. Adding additional materials to supply rigidity to the collar to enable a collar yoke as described in earlier embodiments may not be practical in such boots. Moreover, in order to maintain practicality, designs should enable the collar to breathe and maintain warm weather comfort.

In boot 700, a technique is shown if FIG. 15 that enables the leg collar to continue use of low rigidity canvas type materials for warm weather applications and still benefit from integration of the invention.

Referring to FIG. 15, boot 700 includes an anterior gusset 709 that interrupts a lower eye stay 712 from an upper eye stay 708. The upper eye stay 708 is designed to have significant rigidity to enable it to support a collar yoke cantilever 705. Similarly to a sail boat where the mast supports a boom, the upper eye stay 708 is able to support a collar yoke cantilever 705 with the assistance of at least one cantilever support 706. Cantilever support 706 acts in tension to help connect the collar yoke cantilever 705 with the upper part of the upper eyestay 708. Alignment with eyelets 710 allows the cantilever supports 706 to position their superior anchors to receive further support under tension.

Boot 700 may have two eyestays, upper 708 and lower 712. Collar yoke cantilever 705 and cantilever supports 706 may be all cut from the same blank and be contiguous. Typical materials for boot construction include leather and heavy vinyl sheet among other materials. If these materials are not sufficient to maintain proper shape, these components may be reinforced. An under-layer of supportive material may be added. The upper eye stay 708 may be reinforced by an upper eyestay reinforcement 719. Lower eyestay 712 may be reinforced by a lower eyestay reinforcement 720. Collar yoke cantilever 705 may be reinforced by a collar yoke reinforcement 716. Such reinforcement may include the use of materials such as plastic sheet, carbon fiber, leather, and other materials familiar in the art. Stitching between these elements may add further strength. These elements are shown in FIG. 15B on top of the boot's sock liner and padding system 718 which is presumed to be able to stretch as needed.

Spring Rates

In this system, the collar yoke cantilever 705 can suspend a variety of elastic systems. Elastic sheet material 704 can be anchored below the collar yoke cantilever 705 and above the foot collar 703 and heel counter panel 702 defining at least one elastic member. This elastic sheet material 704 can replace the typical canvas upper material in this area, saving also the cost and weight of the typical material and keeping material costs lower as well as keeping any weight increases lower. Also, the elastic sheet material can be used in combination with an external material that has sufficient aesthetic, stretch and protective qualities but insufficient spring rate to enable desired force. Elastic force potential may also be integrated into an area of the sock liner and padding system 718, by gathering sections of liner and bonding elastic material thereto or removing a section of traditional liner material and replacing with a stretchable material.

The spring rate of the elastic sheet material 704 may provide the entire elastic function of the system. In another configuration, the force of the elastic sheet material 704 may be augmented or replaced by a supplemental layer of elastomeric material 714 in either a sheet, cord or custom shaped configuration.

User Adjustable Spring Rates

In another variation, the supplemental layer of elastomeric material 714 may be adjusted by the user upon demand. By providing at least one user controllable internal anchor, a user can engage a supplemental layer of elastomeric material 714 upon the collar yoke cantilever 705. Snaps, buttons, hook and eye, hook and loop are all methods of enabling adjustable tension on a supplemental layer of elastomeric material 714 within the boot.

One approach to engaging the supplemental layer of elastomeric material 714 is to have the material be anchored near the bottom of a heel counter, behind the heel counter away from contact with the skin. A connector such as a length of shoe lace material may be affixed to the top of the supplemental layer of elastomeric material 714. This length of shoe lace would be of similar aesthetic uniform design but not be contiguous with the main lace used for tightening the boot. This connector lace could be guided past the collar yoke cantilever 705 and adjacent to a cantilever support 706 to an eyelet 710, out one eyelet 710, along the outside face of an upper eyestay 708 and back into another eyelet 710, down adjacent to another cantilever support 706, past the collar yoke cantilever 705 to the same or separate supplemental layer of elastomeric material 714. In this way, the connector lace would lay flat against upper eyestay 708 when the supplemental layer of elastomeric material 714 is gently engaged, and could be pulled tight to a plastic hook on the opposite side eyestay 708 to more fully engage the supplemental layer of elastomeric material 714. In this way, the engagement of the supplemental layer of elastomeric material 714 would be controlled by a connector lace and plastic hook of similar appearance to the main lace and plastic hooks of boot 700, without need for supplemental knots, fasteners and the like. This configuration continues the principles of a force/energy management system herein that further support integration within footwear and conformity with required aesthetic limitations.

In applications without uniform regulations which prohibit external appendages, a number of other mechanisms may be employed to allow the user to control and adjust the spring tension. For example, cam lock systems, adjustment screws, tuning screws similar to those on guitars and the like may be used.

Reinforcement and Rotation

In all of these variations of boot 700, the upper eyestay 708 will be pulled downward when the elastic system is engaged. To resist slumping down the leg, the upper eyestay 708 may be supported by the lower eyestay 712 as well as the foot collar 703. These are shown in one contiguous material in FIG. 15A. This contiguous element can be further reinforced by the upper eyestay reinforcement 719 and the foot collar reinforcement 720 which anchors the unit to the sole (FIG. 15B). These reinforcements are shown non-contiguous, with mating surfaces that resemble a ball joint. The point of rotation is designed to be aft of the anterior gusset 709 to move it closer to the ankle joint. In this embodiment foot collar reinforcement 720 passes over the heel counter 715 as well as the structural toe protector 721, but may be incorporated with them. Said reinforcement elements, by virtue of their strength and anchoring to the sole provides the upper eye stay 708 with support to prevent sliding down the ankle as well as a favorable rotation point for driving necessary spring performance.

Stitching for Rotation

The stitching of the eye stays 708, 712 may be altered in the vicinity of desired rotation. Eyestays are typically stitched to the upper on their fore and aft sides. This may be altered in the rotation area, for example, by switching from straight stitching on the fore and aft sides to zig zag stitching in the rotation area to enable some laxity in the leather while in the rotation area. Or, the straight stitching from the fore side of the upper eye stay 708 may be crossed over the mid of the eyestays in the rotation area, and similarly the fore side stitching of the lower eyestay 712 may be crossed over the mid of the eyestays in the rotation area. These two intersecting straight stitches would then create an "X" at the center of desired rotation area.

Applications of the Embodiment

People wear boots with different vocational requirements than sneakers. Often, this means that the same pair of boots is worn for extended hours for repeated days. Boots are exposed to harsh terrain and a broad variety of outdoor climates. Military troops are often given a small yearly stipend of money that is used towards the purchase of boots, resulting in the demand for low cost boots which may lack higher priced features such as glove leather linings. New boots are often considered stiff and this stiffness results in significant motion of the foot within the boot during the gait cycle, as the foot tends to flex while the boot does not. This is further exacerbated when boots are purchased that do not have the desired fit to the user's foot. This lack of flexibility and comfort features can lead to the formation of unwanted blisters, calluses and sore spots.

Boots are typically worn as a primary piece of footwear across multiple activities. These activities may include low impact activity such as meal preparation or warehouse work for much of the day, interspersed with infrequent bursts of high impact activity such as running, jogging or marching.

The anterior and posterior gussets of boot 700 provide better range of motion of the boot when new. This allows the high collar of boot 700 to rotate evenly with the lower leg and the main part of the boot to stay stationary relative to the foot. This reduces unwanted motion and friction between the foot/leg and boot 700 and improves comfort.

The elastic sheet material can provide primary tension spring performance that supplies a low baseline of spring rate action. This low spring rate has the capability to pull the heel of the boot close to the heel of the foot, similar to a pair of suspenders. This reduces movement between the heel of the boot and heel of the foot, which is a primary cause of friction that leads to blistering and pain, thereby reducing the tendency towards blistering.

The primary tension spring force from the elastic sheet material also provides a low baseline of active support to the ankle system, thereby externalizing some tendon and muscle force outside the body and into the boot. This small benefit may accrue over a full day of use of the boots to reduce fatigue.

The supplemental tension spring force may be engaged when desired. For example, if the user is preparing for a hike or a march, the supplemental tension spring could be engaged prior to the start of the activity and released upon its conclusion. Thus, the performance benefits of the supplemental tension spring would be available on demand without requiring the user to have it engaged throughout the entire day. This can be beneficial when carrying backpacks and materiel. Each additional Newton of materiel translates to a corresponding increase on Achilles tendon force, typically cited as 1.2 to 3.0 depending upon activity & gait. A backpack weighing 270 Newton (~0.60 pounds) will require additional exertion by the wearer carrying it. Using the enclosed invention with a spring rate of 30 N/cm, could offset 8 to 20% of the force of the pack upon the Achilles, thus delivering a significant dynamic weight reduction (dynamic reduction of 4 to 12 pounds) with a minimum addition of weight or cost to the boots.

The geometry of such a force/energy management system enables it to transform some of the work into electrical current which can be stored or used as it is generated. For example, an elastic member may include a coaxial device that enables generation of electric current as the elastic element is stretched and or released. A variety of small power harvesting mechanisms may be employed, examples comprise but are not limited to solenoids, coils, piezoelectrics, micro-electric generator systems, reciprocating members to drive alternators, and the like.

More aggressive performance characteristics could be realized by the integration of high performance supplemental support systems. While boot manufacturing practices often use plastic sheet for heel counter reinforcement, it is also known that stamped metal pieces are common for use in steel toes and metal shanks. High performance plastics, fiberglass and carbon fiber are also known in high performance boot applications such as cold weather boots. As such, manufacturers familiar with such materials may choose to offer a boot with high strength reinforcements that would enable a more aggressive primary or secondary spring rate to be used.

Structural elements and a force/energy management system and the principles thereof of boot 700 may be adopted into other types of footwear, especially athletic shoes, trail running shoes, low hiking boots, including variations of the several embodiments of footwear described above. For example, aspects of the collar yoke cantilever 139 and adjustability mechanisms shown in FIG. 7B as a convenient means of showing how such technologies are applied across footwear types may be applied across the several shoe embodiments described herein including boot 700. Similarly, concepts from earlier embodiments can be applied into the boot category.

Other embodiments of footwear may come to the mind of one of ordinary skill in the art of footwear design through an understanding of the principles of the structural elements of a force/energy management system as described herein. Further variations than those described above are within the appreciation of one skilled in the arts and such variations are to be considered within the scope of the claims which follow. Any patents, provisional application, published applications and articles referred to herein should be deemed to be incorporated by reference as to their entire contents and their descriptions and backgrounds to supplement the discussion of the several embodiments described herein.

BIBLIOGRAPHY

1. Sawicki, G S, Ferris, D P. Powered ankle exoskeletons reveal the metabolic cost of plantar flexor mechanical work during walking with longer steps at constant step frequency. The Journal of Experimental Biology; 212: 21-31. 2009
2. Sawicki, G S, Lewis, CL, Ferris, D P. It pays to have a spring in your step. Exercise Sport Science Review; Vol. 37, No. 3: 130-138. 2009.
3. Ferris, D P, Sawicki, G S, Daley, M A. A physiologist's perspective on robotic exoskeletons for human locomotion. International Journal of Humanoid Robotics; Vol. 4, No. 3: 507-528. 2007
4. Cain S M, Gordon K E, Ferris D P. Locomotor adaptation to a powered ankle-foot orthosis depends on control method. Journal of Neuroeng Rehabil. 2007 Dec. 21; 4:48.
5. Gordon, K E, Sawicki G S, Ferris, D P. Mechanical performance of artificial pneumatic muscles to power an ankle-foot orthosis. Journal of Biomechanics 39: 1832-1841. 2006

The invention claimed is:

1. Footwear comprising a rotatable top collar yoke capable of rotation relative to a remaining portion of a shoe, the rotatable top collar yoke comprising an anterior gusset and a posterior gusset, the anterior and posterior gussets forming a channel therebetween;

the shoe supported by an elastomeric overlay comprising first and second zones, the first and second zones comprising a rotation zone supporting the channel and an elastic zone defining a region of elastomeric activity and creating a tension spring.

2. The footwear according to claim 1, the rotatable top collar yoke comprising X stitching in the vicinity of the channel.

3. The footwear according to claim 1, the elastomeric overlay being bonded at reduced zones of bonding agent at a superior and inferior elastic anchor zone.

4. The footwear according to claim 1, the elastomeric overlay being anchored at a rear of the footwear to a heel portion of the shoe.

5. The footwear according to claim 1 further comprising yoke eyelets of the elastomeric overlay for selectively adjusting the elastomeric overlay by adjustably lacing the yoke eyelets.

* * * * *